US005728334A

United States Patent [19]

Lee

[11] Patent Number: 5,728,334

[45] Date of Patent: Mar. 17, 1998

[54] DWS SYSTEM METHOD FOR MANUFACTURING PRE-CAST CONCRETE MODULES

[75] Inventor: Ho Woo Lee, Seoul, Rep. of Korea

[73] Assignee: Daewoo Hawaii Corporation, Honolulu, Hi.

[21] Appl. No.: 597,140

[22] Filed: Feb. 6, 1996

Related U.S. Application Data

[62] Division of Ser. No. 357,458, Dec. 16, 1994, Pat. No. 5,643,488.

[51] Int. Cl.[6] ..... B28B 1/14; B28B 7/22

[52] U.S. Cl. ..... 264/82; 264/162; 264/232; 264/250; 264/275; 264/279; 264/279.1; 264/333; 264/340

[58] Field of Search ..... 425/62, 63, 441, 425/442, 443; 249/33, 34, 38, 39, 40, 47, 118, 144, 159, 161, 162, 165, 166, 170, 190, 192, 193, 194; 264/333, 275, 250, 251, 253, 279, 279.1, 232, 162, 340, 82

[56] References Cited

U.S. PATENT DOCUMENTS 1,679,040 7/1928 Lake ..... 249/39
3,595,514 7/1971 Sanders ..... 249/192
3,743,232 7/1973 Vaughan ..... 249/34
4,272,050 6/1981 del Valle ..... 249/144

*Primary Examiner*—Karen Aftergut
*Attorney, Agent, or Firm*—Oppenheimer Poms Smith

[57] ABSTRACT

A form assembly for forming vertical concrete walls for prefabricated apartment and office modules. The form assembly has a wall form having a plurality of internal wall forms and corresponding external wall forms. The wall form is connected to a support structure, and a plurality of hydraulic lifting cylinders connect to the support structure to raise and lower the wall form. The form assembly may also have hydraulic open and close mechanisms, hydraulic form ties and a control console for the hydraulic system. External corner mechanisms may be provided for locking the external form corners in place prior to concrete pouring. An efficient method of manufacturing the modules includes several steps. Slab reinforcement bars and conduits are layed on a slab deck. Concrete is poured over the slab reinforcement bars and conduits to form a slab. Wall reinforcement bars and conduits are erected on the slab for vertical walls. Form pairs are hydraulically lowered and are hydraulically closed about the pattern of wall reinforcement bars and conduits. Concrete is poured into the closed form pairs, and the concrete is steam cured. The form pairs are hydraulically opened and raised.

9 Claims, 19 Drawing Sheets

LEGEND:

PUSH BUTTONS

SELECTOR SWITCHES

LIGHTS

DWS SYSTEM METHOD FOR MANUFACTURING PRE-CAST CONCRETE MODULES

This application is a division of U.S. patent application Ser. No. 08/357,458, entitled DWS SYSTEM (DAEWOO MULTI-ROOM MODULAR CONSTRUCTION SYSTEM), filed Dec. 16, 1994, now U.S. Pat. No. 5,643,488.

BACKGROUND OF THE INVENTION

1. Field of the Invention

The present invention relates to a method of forming three dimensional, prefabricated concrete modules, and to a form assembly for forming the vertical walls thereof.

2. Description of Related Art

At one time, many months and a large labor force were necessary in order to construct an office or apartment building. Workers would typically first erect a large steel frame, and then pour concrete slabs and walls directly on the structure. This traditional approach was labor intensive, time consuming and expensive.

Several approaches were subsequently developed to construct office and apartment buildings at a lower cost and in a shorter period of time than the traditional method. For example, U.S. Pat. No. 3,812,637 (Yang et al.) teaches a method for erecting a reinforced concrete building in which concrete floor slabs, wall panels and box units are prefabricated at a factory and transported to the building site. The various components are arranged at the building site by crane, and laborers connect the components together to form a building. Unfortunately, a building constructed with this method has a large number of joints, which serve to weaken the building in an earthquake or under severe wind loading. Furthermore, extensive labor time is required to interconnect the many prefabricated components.

U.S. Pat. No. 4,525,975 (McWethy) discloses a method for erecting a building in which modules having a concrete base and lightweight side walls are stacked aside and upon one another to form a building. Concrete is poured between the spaced walls of the modules to form supporting concrete walls. One advantage of this approach is that the modules may be constructed at the building site. However, the need to pour a large number of concrete walls within the building causes delays, as the concrete walls must dry at each floor before the next floor can be added. Additionally, substantial labor is required to pour the concrete walls.

Other methods have been developed in which modules are fabricated on the ground and then lifted into place on the building. However, these methods require substantial manual labor for such tasks as opening and closing the concrete forms, locking and unlocking the forms, and/or installing blockouts for doors and windows before the concrete is poured. Consequently, the module fabrication process is time consuming and labor intensive.

Existing methods generally also do not provide convenient access to the vertical rebar structure, which is typically constructed within vertical wall forms. As a result, it is very difficult to readjust the location of electrical conduits, connector boxes and other vertical wall components that move out of position before the concrete is poured.

SUMMARY OF THE INVENTION

Broadly considered, an efficient method of manufacturing precast concrete modules in accordance with the present invention has several steps. A pattern of slab reinforcement bars and conduits is first assembled. Concrete is poured over the pattern of slab reinforcement bars and conduits to form a slab. A pattern of wall reinforcement bars and conduits is erected on the slab. Form pairs are hydraulically lowered to encompass the wall reinforcement bars and conduits. The form pairs are hydraulically closed about the wall reinforcement bars and conduits, and concrete is poured into the closed form pairs. The concrete is steam cured, and the form pairs are hydraulically opened. The form pairs are hydraulically lifted to a position above the vertical concrete walls.

The present invention is helpful in overcoming the shortcomings of the prior art in a number of ways. First, a substantial increase in efficiency is achieved by hydraulically raising and lowering the forms, and by hydraulically opening and closing the forms. Secondly, a substantial savings in labor costs is realized as compared to methods requiring manual installation and removal of the forms.

Thirdly, the hydraulic system can typically be conveniently operated from one or more control panels. Fourthly, once the forms have been hydraulically raised, the module may be moved to another location for finishing before the concrete has fully cured, thereby promoting efficiency. Additionally, the method can produce three-dimensional modules comprising an entire office or apartment. A building constructed therefrom has few joints and has significant structural strength.

In one preferred embodiment of the method, each form pair has an interior form and an exterior form. Each interior form is hydraulically tied to its corresponding exterior form to prevent the interior and exterior forms from moving relative to one another during concrete pouring. Two external forms may be positioned adjacent to one another so as to form an external corner, and the method may include the step of locking the corner into place.

The method may further include blocking out openings in the module, such as openings for doors, windows or the like, with the blockouts extending from and being connected to the walls of the form pairs. Finishing tasks may be performed on the concrete walls such as, for example, filling in holes in the walls, removing excess concrete, installing interior walls made of dry wall and installing electrical conduits, plumbing lines and the like in those interior walls.

The method may also include lifting a completed module into its proper place on the building. The module has connector plates that are then welded to corresponding connector plates on adjacent modules, with open spaces between the modules being filled in with structural mortar.

The step of opening the forms may include rotating the external forms open so as to provide a work space in between the open external form and the vertical rebar pattern. A worker can then enter the work space to adjust the position of rebars, conduits, boxes and the like before the form is closed and the concrete poured. The worker may also enter the workspace to move or replace one or more of the blockouts, which may be bolted or otherwise attached to the form walls.

One preferred embodiment of a form assembly for forming the vertical concrete walls of prefabricated apartment and office modules has a wall form having internal wall forms and corresponding external wall forms. The wall form may be connected to a support structure, which is supported by one or more hydraulic lifting cylinders. One or more hydraulic internal form mechanisms may open and close the internal forms, while one or more hydraulic external form mechanisms may open and close the external forms. A control panel may be provided for controlling the hydraulic lifting cylinder and the hydraulic internal and external form mechanisms.

Considering another preferred embodiment, the form assembly has an automatic control system to maintain the sides of the form at an even vertical level as the form ascends and descends. The automatic control system may include a programmable logic control unit (PLC) that is connected to hydraulic lifting cylinders to independently control the extension of the individual lifting cylinders.

Considered more broadly, a form assembly for forming vertical walls on a reinforced concrete module for office and apartment buildings has several wall form pairs, with each pair having an inner form and an outer form. The wall form pairs may be suspended from a support structure, which is supported by hydraulic cylinders. The hydraulic cylinders have an extended position in which the support structure and the form pairs are raised above the wall rebar cage, and a retracted position in which the form pairs are lowered about the wall rebar cage.

Other objects, features and advantages of the invention will become apparent from a consideration of the following detailed description and the accompanying drawings.

DETAILED DESCRIPTION OF THE PREFERRED EMBODIMENTS

Figure 1:
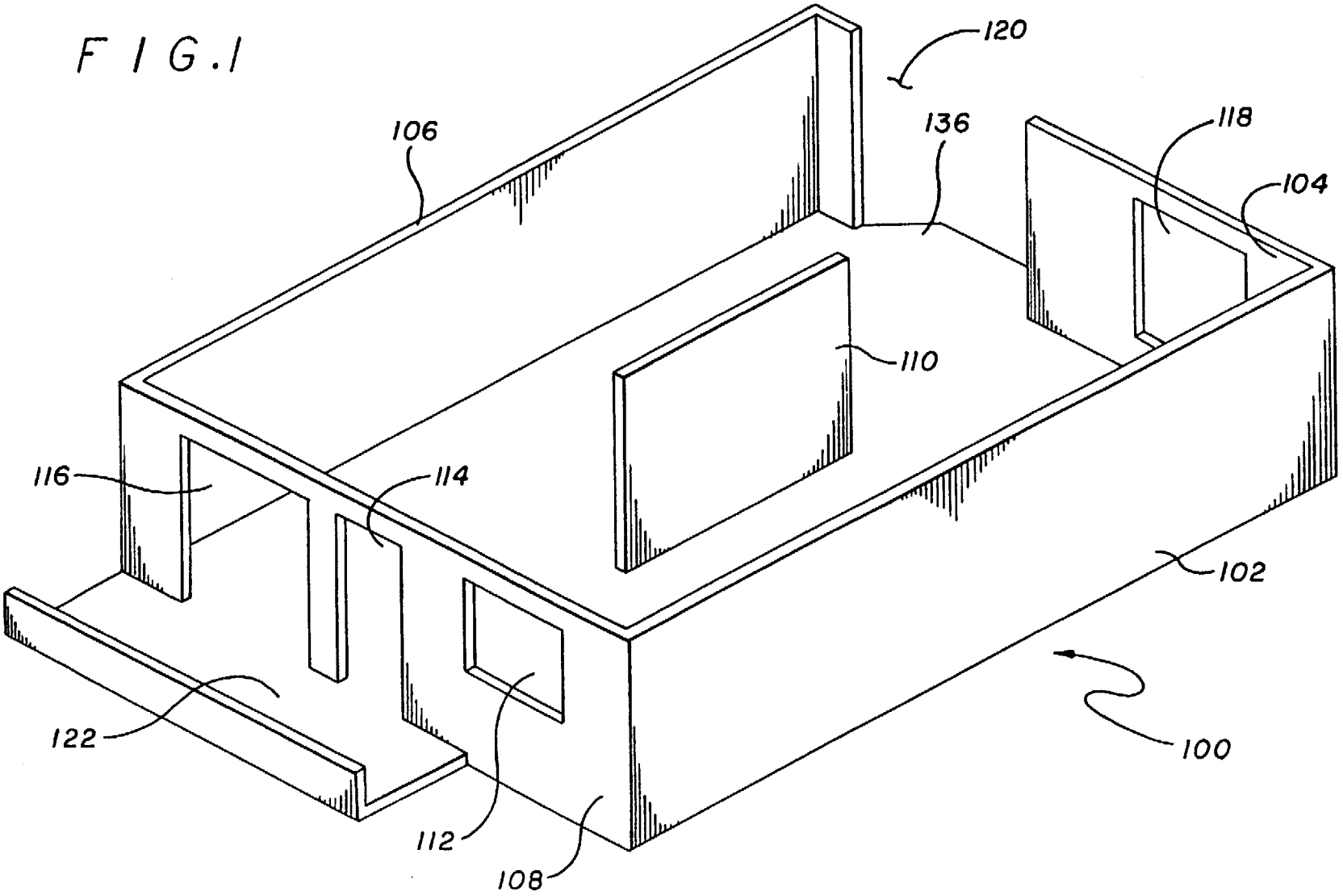
FIG. 1 is a perspective view of a three-dimensional, precast concrete module for constructing an apartment or office building.

Referring more particularly to the drawings, FIG. 1 is a perspective view of a three dimensional concrete module unit 100. The module 100 includes four reinforced concrete outer walls 102, 104, 106 and 108, as well as one reinforced concrete center wall 110. Outer wall 108 includes an opening for a window 112, another opening for a door 114 and an opening for a kitchen window 116. Outer wall 104 includes a window opening 118 and an opening 120 for a sliding glass door. The module 100 comprises a complete office or apartment, and includes a pre-cast corridor 122. The module is finished by adding interior dry walls. Electric conduits and dowels for connecting vertical rebars are pre-installed within the concrete walls.

Figure 2:
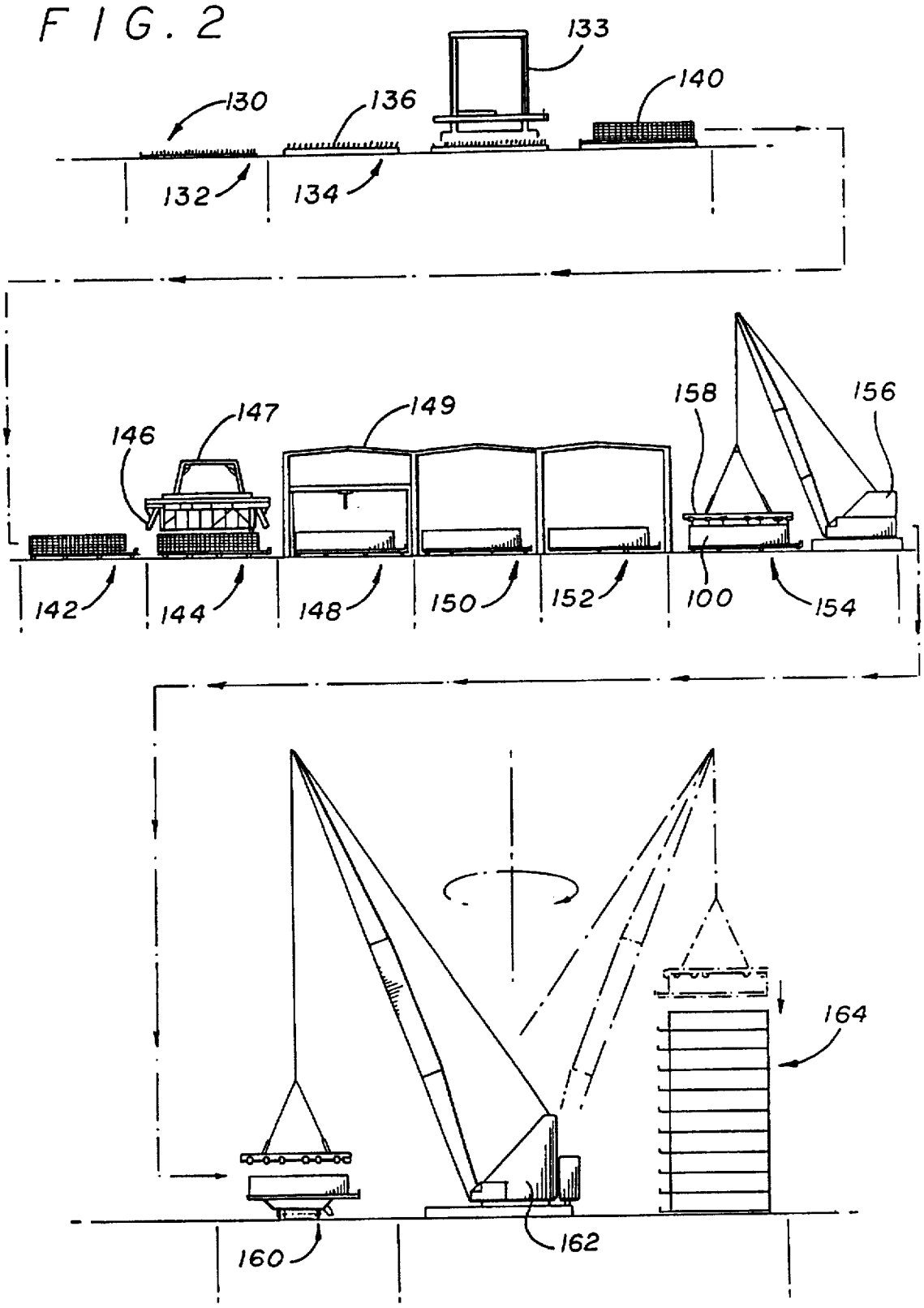
FIG. 2 illustrates a method of manufacturing the module of FIG. 1 and constructing a building out of such modules.

Module 100 is constructed in a multi-step, multi-station method. Referring now to FIG. 2, a slab reinforcement bar (rebar) assembly 130, which includes electrical conduits, boxes, special module connectors and dowel bars intertwined with the rebars, is constructed on a rebar assembly deck at first location 132. Locations of the electrical conduits, boxes and module connectors are marked on the deck in advance to ensure that the components are precisely located.

A travelling crane 133 then moves the slab rebar assembly to a slab form at location 134. Once blockouts for connectors, plumbing and electrical lines are located on the slab form, the crane 133 lowers the rebar assembly on the slab form. A concrete slab 136 is poured about slab rebar pattern 130, with the blockouts providing the appropriate passages in the concrete slab. After the concrete has been steam cured, the slab is tested for strength.

At the same location 134, a vertical rebar pattern 140 is constructed to form the basis for the vertical walls. The rebar pattern 140 also includes electrical conduits for easy installation of the electric wiring. FIG. 2 shows the process of constructing the vertical rebar pattern in separate phases, although these phases are actually occurring at the same location.

A straddle crane next lifts slab 136 to a new location 142, at which the slab is placed on four dollies, each dolly having four Hillman rollers. The Hillman rollers rest on two 300 foot long rails spaced approximately 18 feet 6 inches from one another. The rail/roller combination provides a convenient arrangement for moving the slab from location to location. It may be noted that various separate rails may be provided at location 142, with each rail leading to one of several module production lines.

Once the unfinished module is set on the dollies, the module is rolled along the rails to location 144, underneath a set of raised and open vertical wall forms 146. The wall forms are the "wall mold" into which concrete is poured to manufacture the vertical walls of module 100. The wall forms are raised and lowered by hydraulic cylinders connected to a beam structure that supports the hanging forms. For reference, a concrete pump 147 is shown above the forms.

The slab must be precisely positioned underneath the forms so that the forms may properly lower over the vertical rebar assembly 140. Side guides are provided on each side of the rolling slab to ensure proper alignment underneath the raised wall forms. A front stop is also provided to further ensure proper alignment.

With the slab in place, the hydraulic cylinders lower wall forms 146 to about one inch above the slab. The wall forms are then hydraulically closed about the vertical re-bar pattern 140 and lowered onto the slab. The bottom of the forms include bottom rubber seals that must come directly into contact with the slab. Any gaps between the seals and the slab should be manually plugged before concrete can be poured into the forms. Workers also manually tie the exterior corners into place.

Concrete is poured into the closed and lowered forms in two rounds. On the first round, concrete is filled only about half way all around, then a second round of pouring fills the forms the rest of the way. Each form panel includes one or more vibrators, and preferably four to six vibrators per panel, which act to vibrate air bubbles out of the wet concrete as it dries. Vibration is typically performed panel-by-panel.

A steam tent is set about the closed forms, and the wet concrete is steam cured by passing hot steam through steam lines running along the forms. Approximately three hours of steam curing is generally performed, although the precise time required depends on the weather, the type of concrete used, admixtures and the concrete wall thickness.

After the wall concrete is cured, workers manually unlock the exterior corner form ties. The wall forms 146 are then hydraulically opened, and are raised by hydraulic cylinders above the fully cast concrete vertical walls. At this point, all of the concrete casting has been accomplished, and only finishing work is left to be done.

The fully cast module is transported along the rails to location 148 within warehouse 149. At location 148, workers clean the walls, repair minor holes such as form tie holes, and grind excess concrete from off of the walls and the slab. Module 100 is then moved to location 150, where interior drywall walls are installed, and then further rolled to a location 152 for adding plumbing pipes and electrical conduits in the interior dry wall.

The now-finished module 100 is next moved to a location 154 where a crane 156 lowers a lifting frame 158 onto the module 100. The lifting frame 158 is connected to the module 100, and the module is lifted onto a transporter (not shown). The transporter moves the module 100 to a new location 160, where another crane 162 lifts the module and stacks it atop other modules to form a building 164. The modules each include connector plates that are welded to corresponding plates on the adjoining modules, with open spaces between the modules being filled-in with structural mortar.

Returning now to the forms, once the module 100 has been moved from location 144, the forms should be lowered for cleaning. All excess concrete remaining on the forms should be removed with a scraper. A coat of form oil should be applied to the form faces, the blockouts (discussed below), the bulkhead and any other surfaces that come into contact with the wet concrete. After oiling, the wall forms are hydraulically raised to permit another module to be rolled into location 144.

Figure 3:
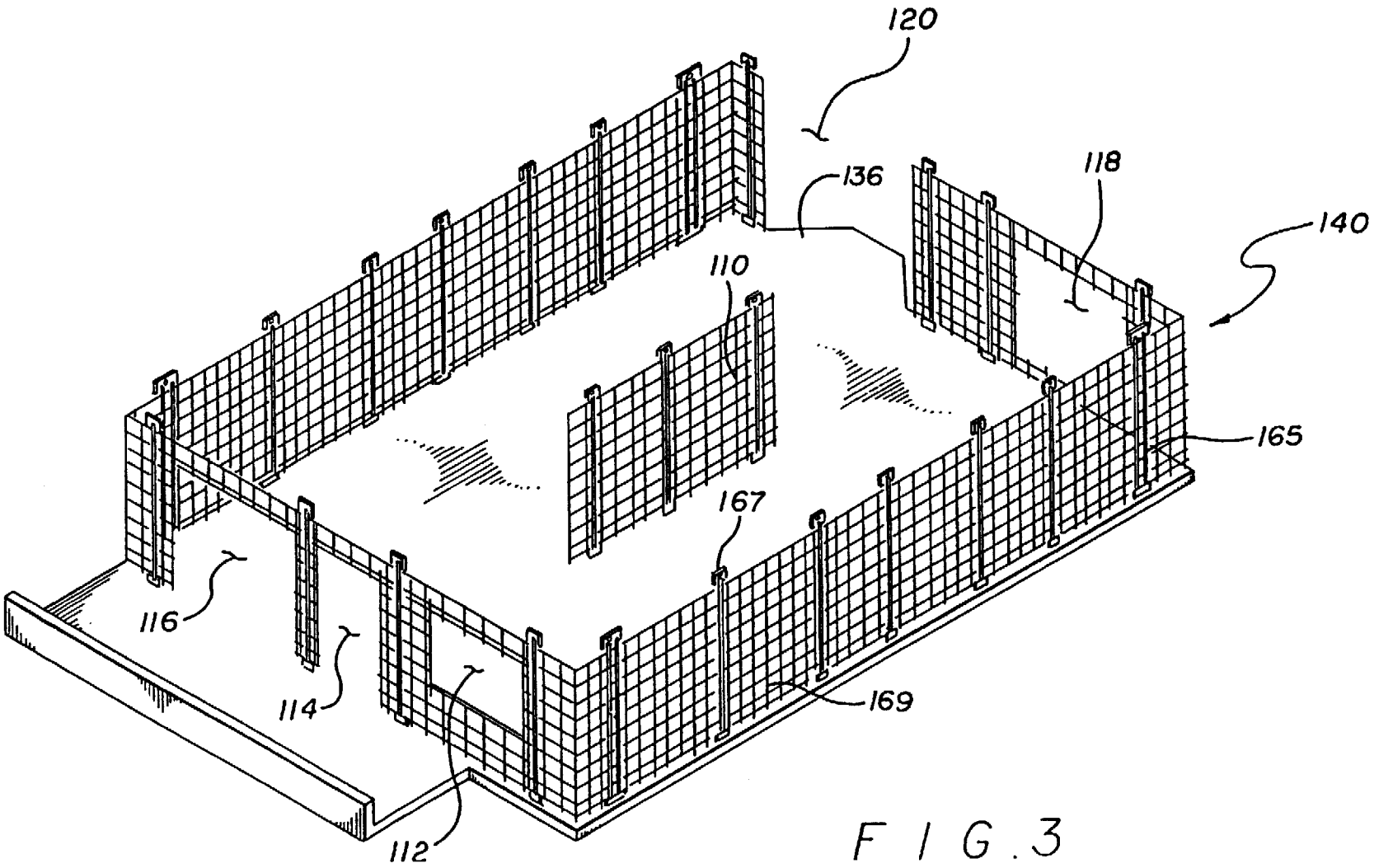
FIG. 3 is a perspective view of an unfinished module having a reinforced concrete slab with a pattern of steel reinforcement bars for vertical walls constructed thereon.

Focusing more particularly at the forming operation at location 144, we see in FIG. 3 the reinforced concrete slab 136 and the reinforcement bar structure for the vertical walls 140, as they would appear prior to the forms being lowered for molding the vertical walls. Openings 112–120 are provided in the reinforcement bar structure 140 for the various door and window openings. A separate substructure of reinforcement bars 110 corresponds to the center wall 110 of FIG. 1. The rebar structure 140 includes extra-strength rebars 165, each having a hook plate 167 at the upper end. The hook plate 167 serves a dual purpose. First, the plate protrudes above the vertical walls after the molding process, thereby providing means for connecting the module to a lifting frame. Secondly, on the building itself, the plates 167 of a lower module protrude up through blocked-out apertures in the slab of the module located immediately overhead. The protruding plates are then welded to corresponding plates on the overhead module to connect the modules together.

The extra-strength bars 165 are typically #8 steel rebars. The bottom ends of bars 165 protrude into openings in the slab, which were created with blockouts during the slab pouring stage, thereby anchoring the bars 165 into the slab. Other vertical and horizontal rebars 169 attach to bars 165 to secure the entire rebar structure 140 onto the slab. The vertical and horizontal rebars 169 are typically #4 steel rebars.

Figure 4:
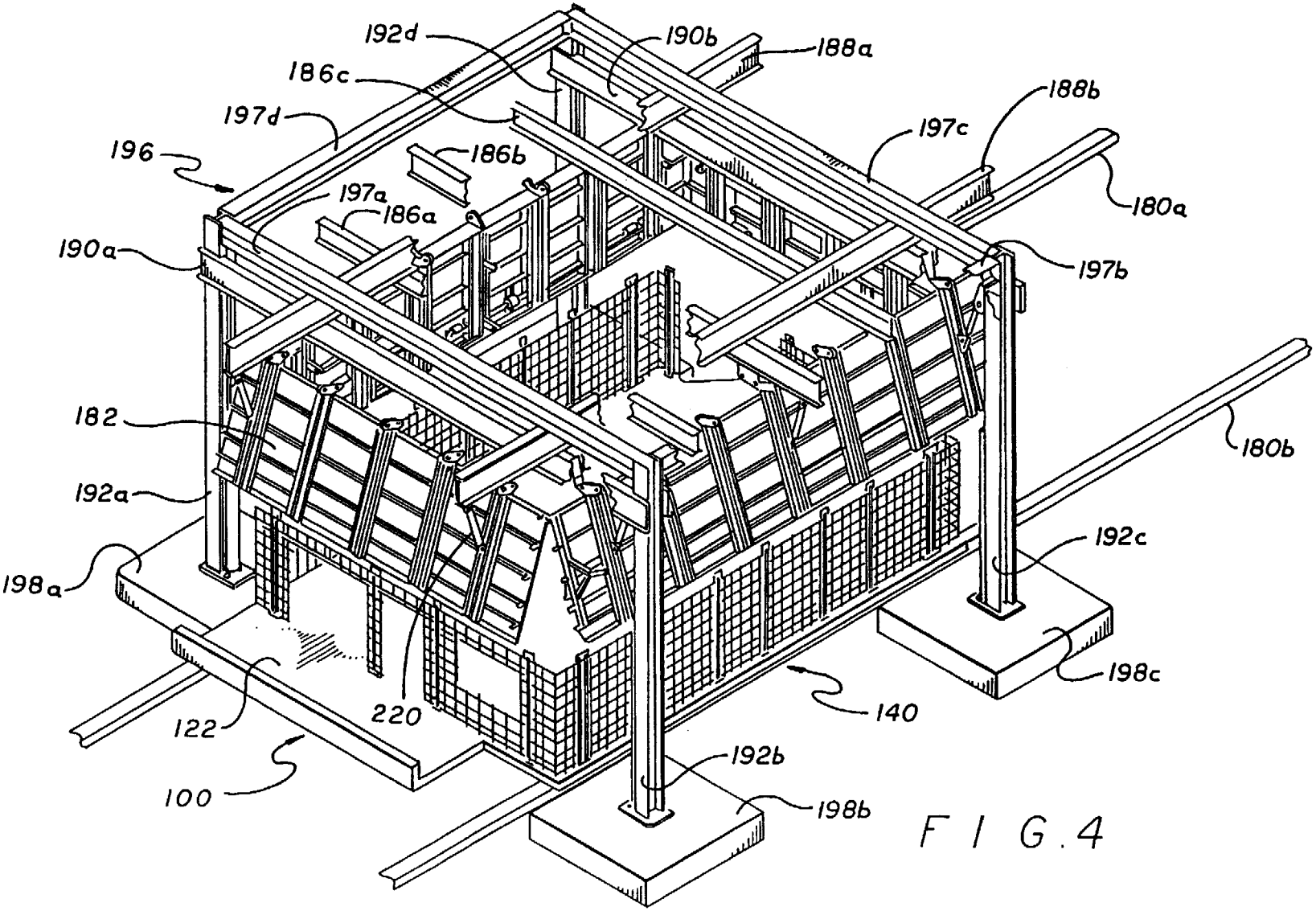
FIG. 4 is a perspective view of the unfinished module of FIG. 3 having been transported along a rail to a position underneath an assembly of raised and open vertical wall forms.

FIG. 4 shows module 100 in unfinished form having been transported along rails 180*a,b* to location 144. The vertical wall reinforcement bar structure 140 is positioned directly underneath raised and open wall forms 182. When wall forms 182 are lowered and closed as in FIG. 5, concrete is poured into the form about the reinforcement bar structure 140 to form vertical walls 102–110 (FIG. 1).

Figure 18:
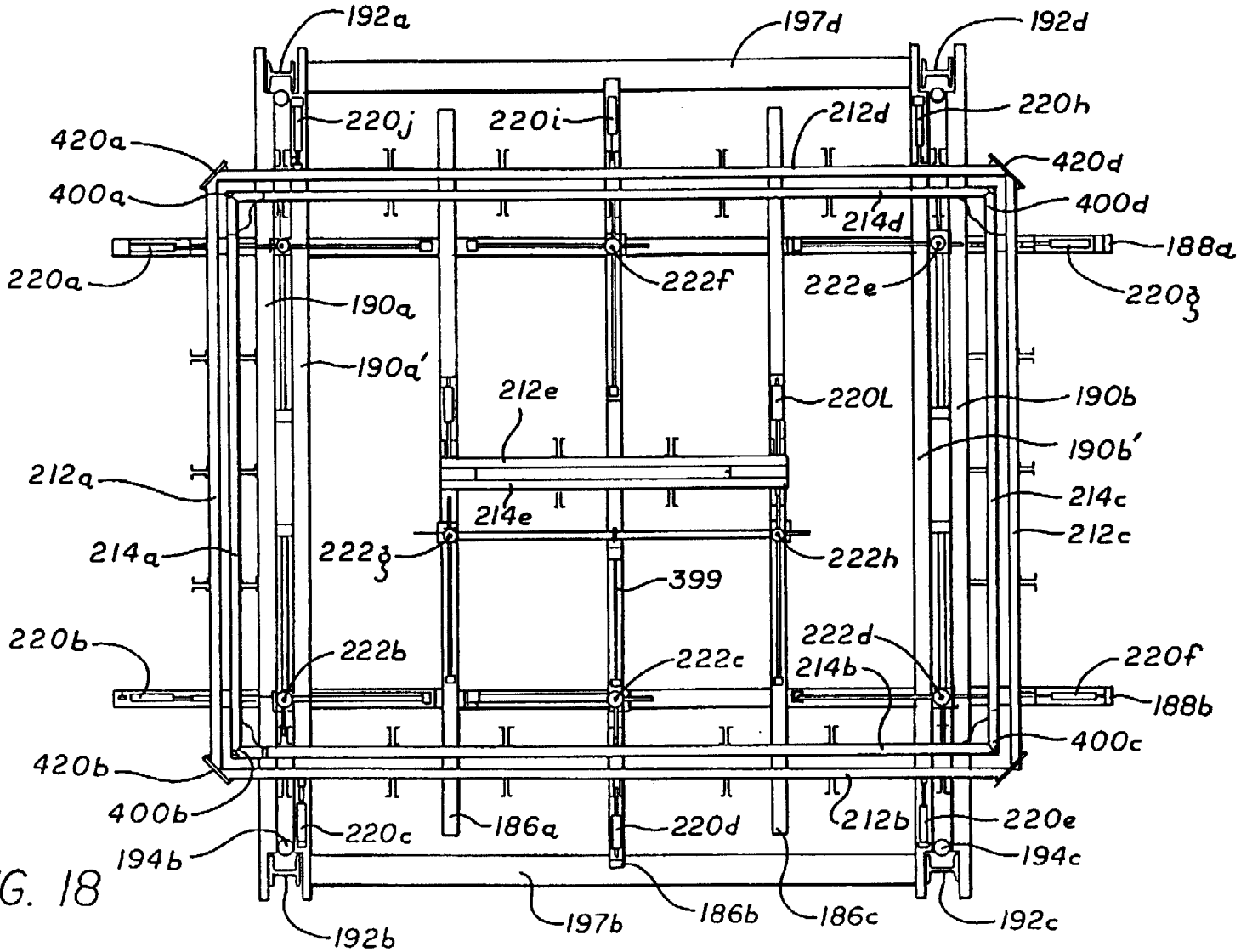
FIG. 18 is a bottom sectional view, looking up at the closed form assembly immediately before concrete is poured to form the vertical module walls.

Returning to FIG. 4, and with reference to FIG. 18, forms 182 are supported by form lifting beams 186*a–c*, by end beams 190*a,a',b* and *b'*, and by perpendicular form lifting beams 188*a,b*. End beams 190 roll along rollers (not shown) along vertical guide columns 192*a–d*. Hydraulic lifting cylinders 194*a–d* are provided immediately adjacent to vertical guide columns 192*a–d*. Each hydraulic lifting cylinder 194 is connected with an associated end form lifting beam 190.

When hydraulic cylinders 194 are hydraulically extended, end lifting beams 190 are forced to roll upward along guide columns 192, until forms 182 are in the fully raised position of FIG. 4. When hydraulic cylinders 194 are hydraulically retracted, end lifting beams 190 roll downwardly along guide columns 192 to the fully lowered position of FIG. 5. An upper beam frame 196 comprising upper beams 197*a–d* provides lateral stability for vertical guide columns 192. Guide columns 192 are anchored in concrete guide column foundations 198*a,b,c,d*.

Figure 5:
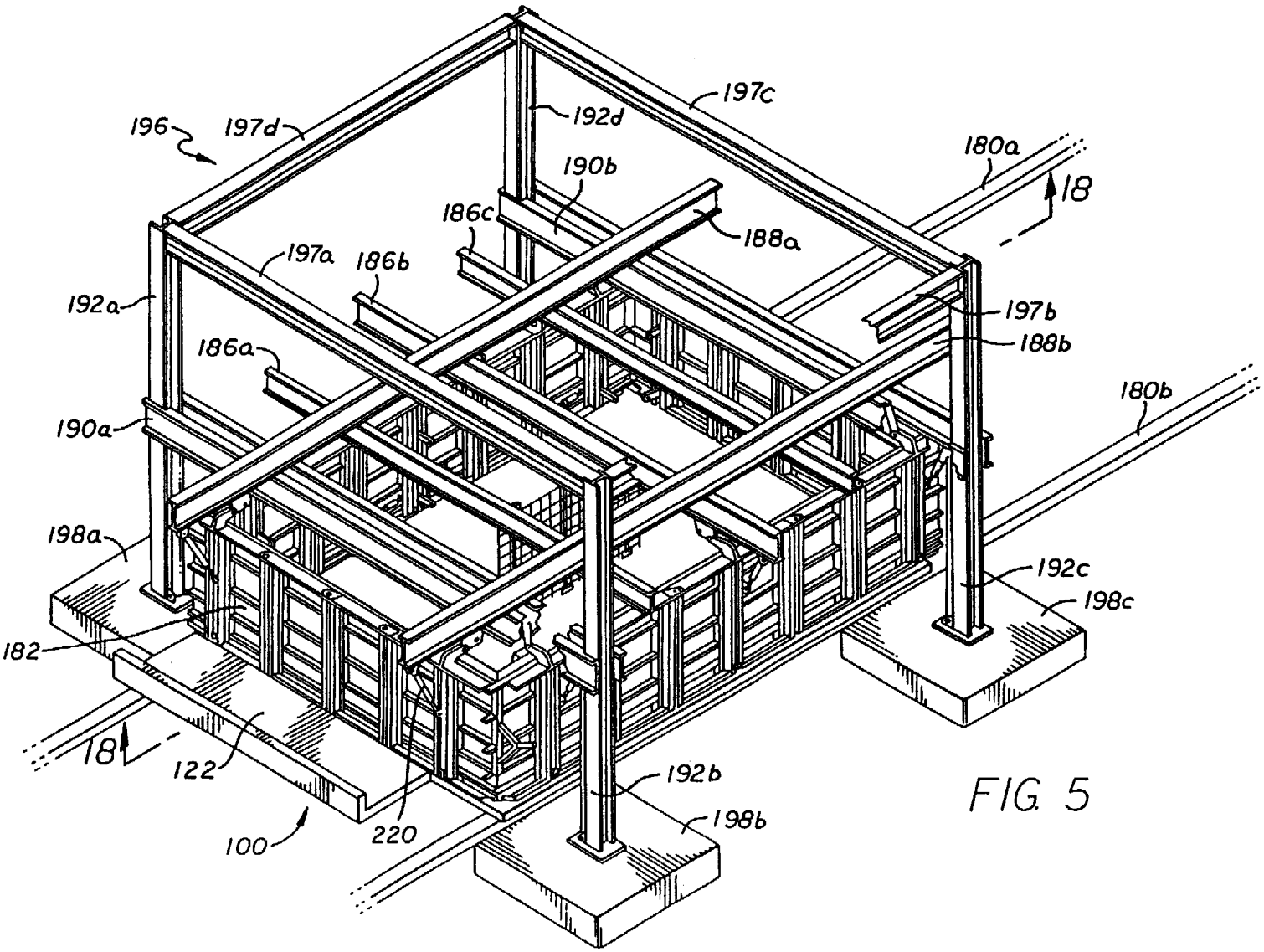
FIG. 5 is a perspective view of the unfinished module and forms of FIG. 4, with the forms lowered and closed about the vertical reinforcement bars of the module, but with some detail of the forms omitted for clarity.

With regard to FIGS. 4 and 5, it should be noted that certain parts of the form assembly 182 have been deleted for clarity of illustration. For instance, there is typically a center form corresponding to interior wall 110, although that form is not shown in FIG. 4 or 5. Various other details, which will be discussed more fully below, have also been deleted for clarity.

Figure 6:
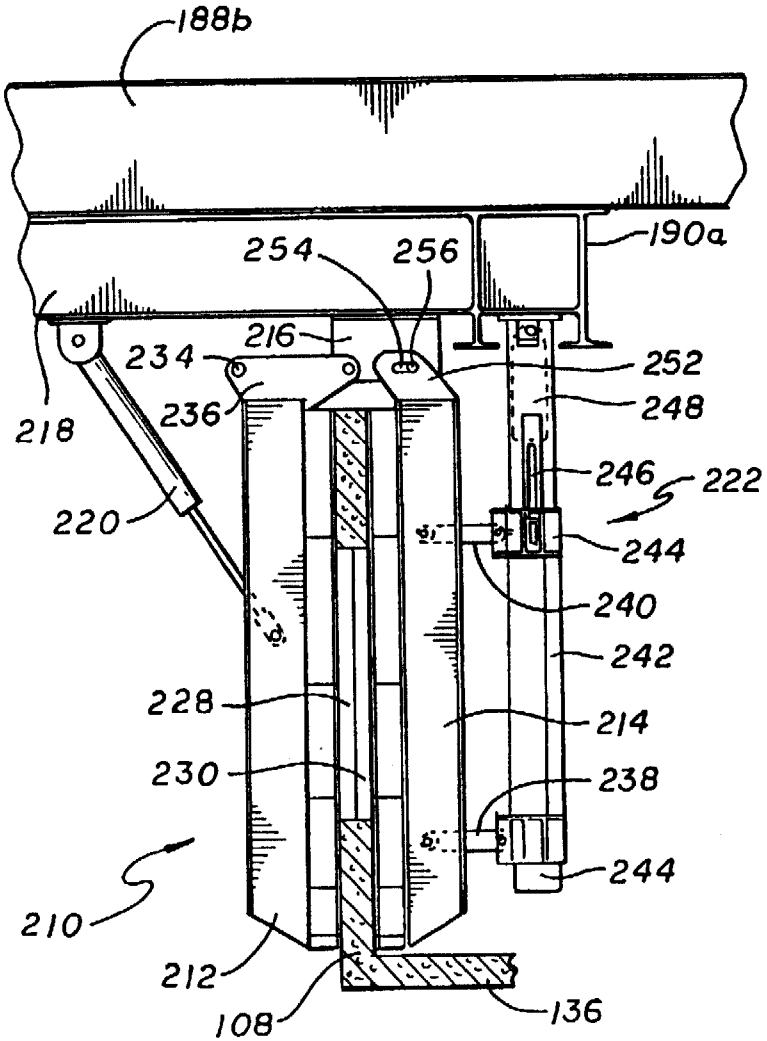
FIG. 6 is a detail view of an external form and an internal form, both in the closed position of FIG. 5.

A significant aspect of the form assembly 182 is a hydraulic system for opening and closing the forms about the reinforcement bar structure 140 for the vertical walls. Referring now to FIG. 6, we see a detail end view taken along line 6—6 of FIG. 5 showing the forms in an enclosed position 210. Each wall of the forms consist of a form pair having an "external" form and an "internal" form. External forms open and close in one manner, while the internal forms open and close in another. Specifically, the external forms rotate outwardly to open and rotate back inwardly to close. The internal forms simply move horizontally in and out to open and close.

FIG. 6 shows an external form 212 and an internal form 214 both closed about a vertical concrete wall 108. Both external form 212 and internal form 214 are connected to a connector plate 216, which is in turn connected to a supplemental frame support beam 218 (not shown in FIGS. 4 and 5 for clarity). This supplemental frame support beam 218 is itself bolted or, alternatively, welded to a form lifting beam 188. Hydraulic cylinder 220 is also mounted onto beam 218, while hydraulic internal form mechanism 222 is welded or bolted to an end form lifting beam 190.

Figure 7:
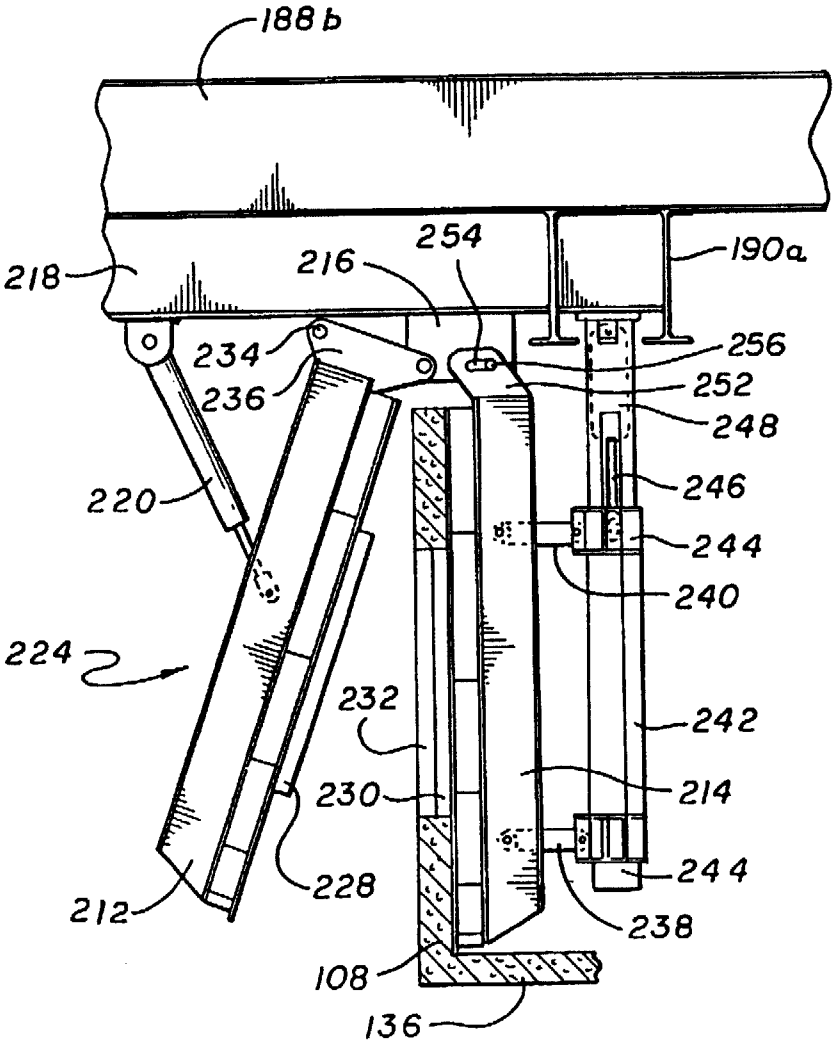
FIG. 7 is a detail view of the forms of FIG. 6, with the external form open and the internal form closed.

Referring now to the opening and closing of the external form 212, FIG. 7 illustrates the external form 212 having been rotated into an open position 224. External form 212 is rotated about pivot point 226 when hydraulic cylinder 220 is retracted. In the fully open position, external form 212 is rotated approximately 15 degrees, so that there is approximately a 3 foot space between the internal form 214 and the bottom of the external form 212.

This 3 foot space between the internal form and the bottom of the external form is designed to allow a worker to work within the space before the form is closed and prior to the concrete being poured. The proper positioning of electrical conduits, connector boxes and the like is critical to module quality control, and a worker can enter the space to properly align these various components.

External form 212 includes a window blockout 228 extending inwardly toward the wall approximately 4 inches. Internal form 214 includes a matching window blockout 230 extending inwardly towards the wall approximately 2 inches. In the closed position of FIG. 6, window blockouts 228 and 230 are immediately juxtaposed to one another to prevent wet concrete from entering the rectangular area defined by window blockouts 228 and 230. Thus, after the concrete has set, vertical concrete wall 108 is left with a window opening 232 seen partially in FIG. 7 and fully in FIG. 8.

Another advantage of providing a work space in between the open external form and the module walls relates to reconfiguring the blockouts. The blockouts are typically bolted onto the form walls, and can be added and removed as desired. The work space allows a worker clearance to unbolt one or more of the existing blockouts from the form walls. A different size blockout may then be bolted or otherwise attached to the form walls. Generally speaking, the size and location of the blockouts may be changed from module to module so as to provide some variety.

Figures 8, 11, 12, 13:
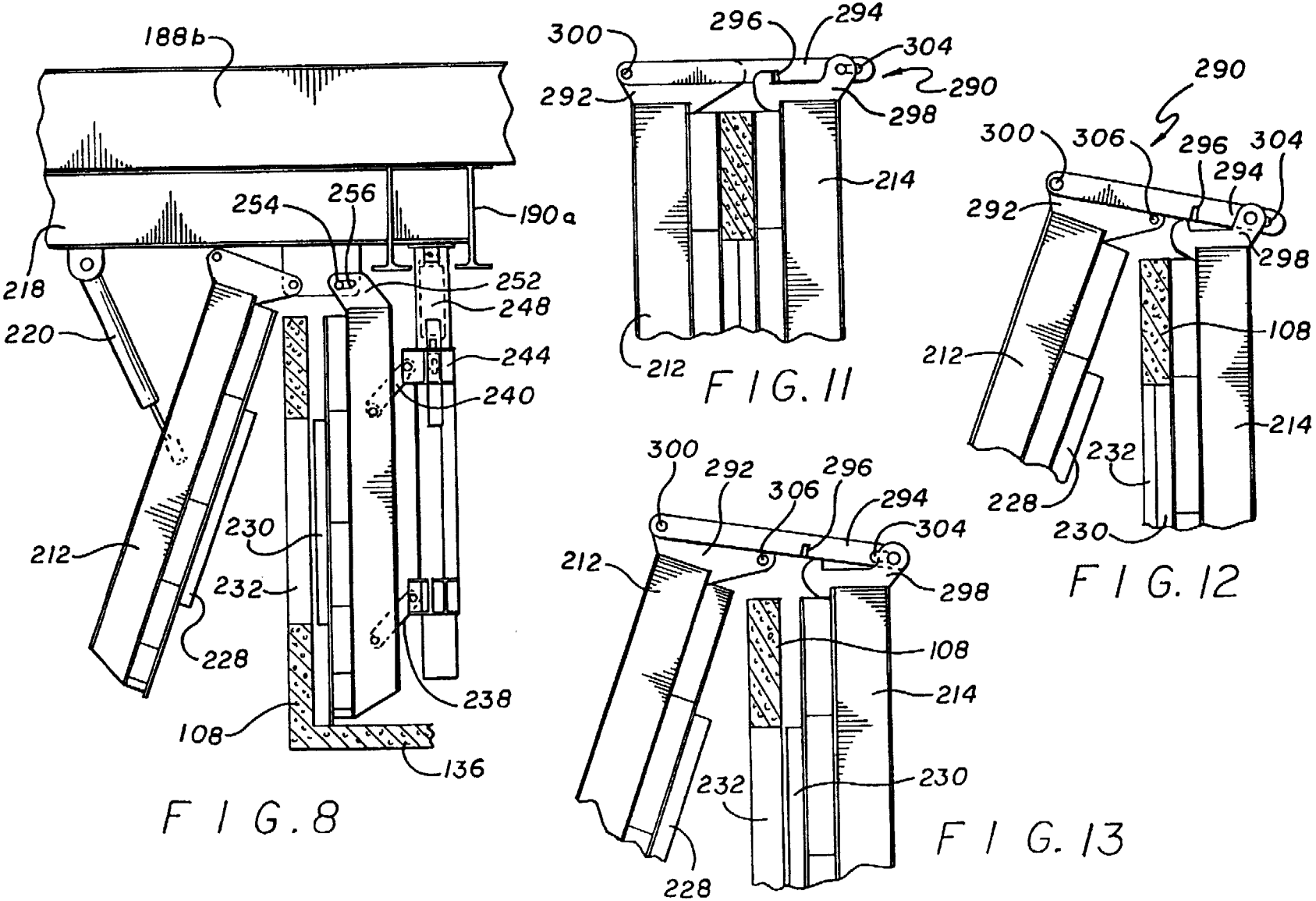
FIG. 8 is a detail view of the forms of FIG. 6, with both the external and internal forms open.
FIG. 11 is a detail view of an external form and an internal form illustrating the upper form ties with the external and internal forms both closed.
FIG. 12 is a detail view of the upper form ties of FIG. 9, with the external form open and the internal form closed.
FIG. 13 is a detail view of the upper form ties of FIG. 9, with external and internal forms both open.

An aperture 234 on pivot bracket 236 is not used for the purposes of FIGS. 6–8. However, aperture 234 is useful in allowing the bracket to be used elsewhere on the forms in a different role, as described below.

Referring now to the opening and closing of internal form 214, FIG. 6 shows internal form 214 linked by links 238, 240 to flanges of a sliding external tube 242. Sliding external tube 242 slides on internal tube 244, which is itself fixed to a form lifting beam 190. When internal form 214 is in the closed position of FIGS. 6 and 7, sliding external tube 242 is at a fully lowered position with the uppermost external tube connection unit 245 at the bottom of internal tube channel 246.

A hydraulic cylinder 248 is seen in FIGS. 6, 7 and 8 in broken lines mounted within the internal tube 244. This hydraulic cylinder 248 has a shaft which connects to an H-bracket 249 (FIG. 9), which is in turn connected to the interior of the upper external tube connecting unit 244. When the hydraulic cylinder shaft 250 of hydraulic cylinder 248 is extended, the internal form 214 is in the fully closed position of FIGS. 6 and 7. However, when shaft 250 is retracted, sliding external tube 242 slides upward relative to internal tube 244. Links 238, 240 rotate counterclockwise, as seen in FIG. 8, thereby drawing internal form 214 horizontally outward. Angle bracket 252 at the top of internal form 214 includes a slot 254.

As internal form 214 moves horizontally outwardly, angle bracket 252 slides outwardly relative to connector plate pin 256. Internal form 214 moves about 4 inches horizontally outwardly to the open position relative to the closed position, so that internal form block out 230, which is about 2 inches wide, comfortably clears vertical concrete wall 108.

Figure 9:
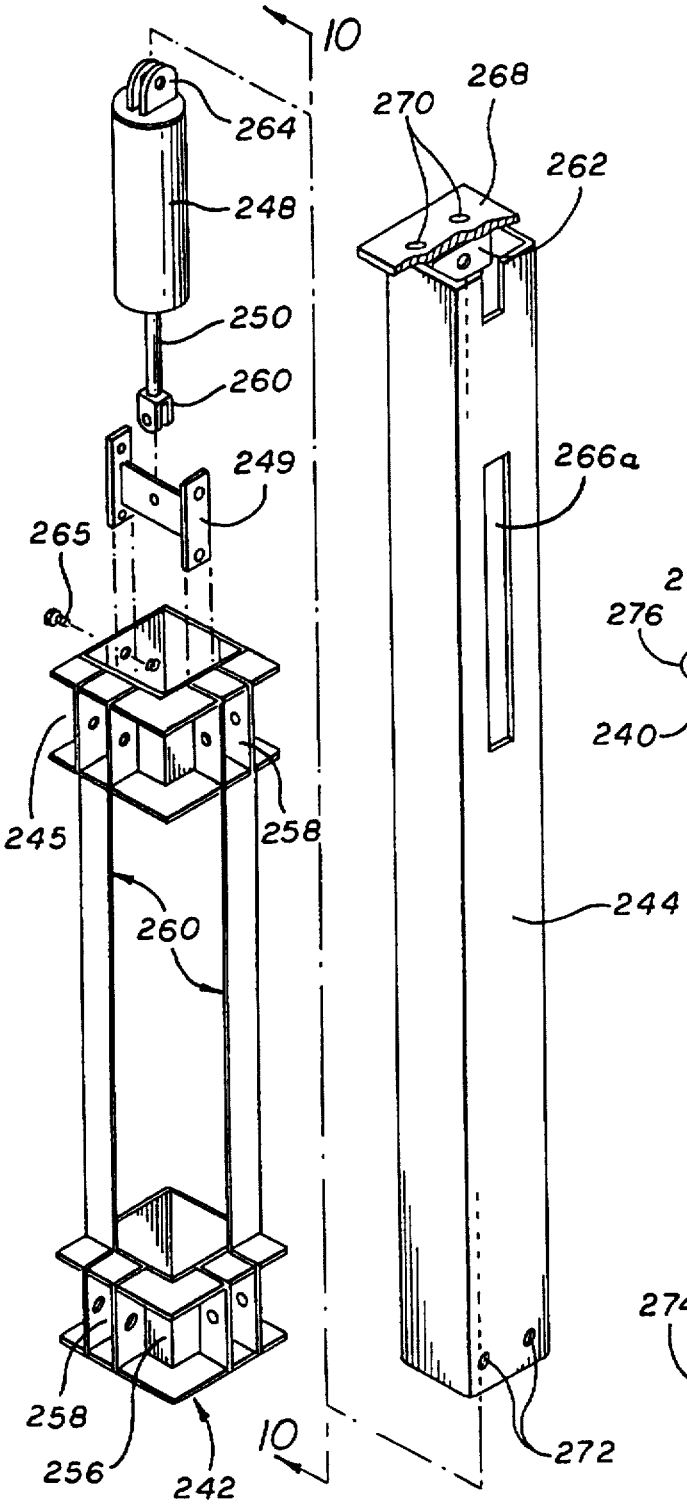
FIG. 9 is an exploded view illustrating the internal form corner mechanism, comprising a stationary internal tube, a sliding external tube and a hydraulic cylinder mounted within the internal tube.

Referring more particularly to the components of the hydraulic internal form mechanism 222, FIG. 9 is an exploded view of the various parts thereof. Sliding external tube 242 includes an upper external tube connecting unit 245 and a lower external sliding tube connection unit 256. Each of the upper and lower connection units 245, 256 include a plurality of mounting flanges 258, having apertures for connecting the connection units with links such as 238, 240 (FIG. 6), the links being connected on the other end to an internal form. The upper and lower external tube connecting units are connected by angle irons 260.

Figure 10:
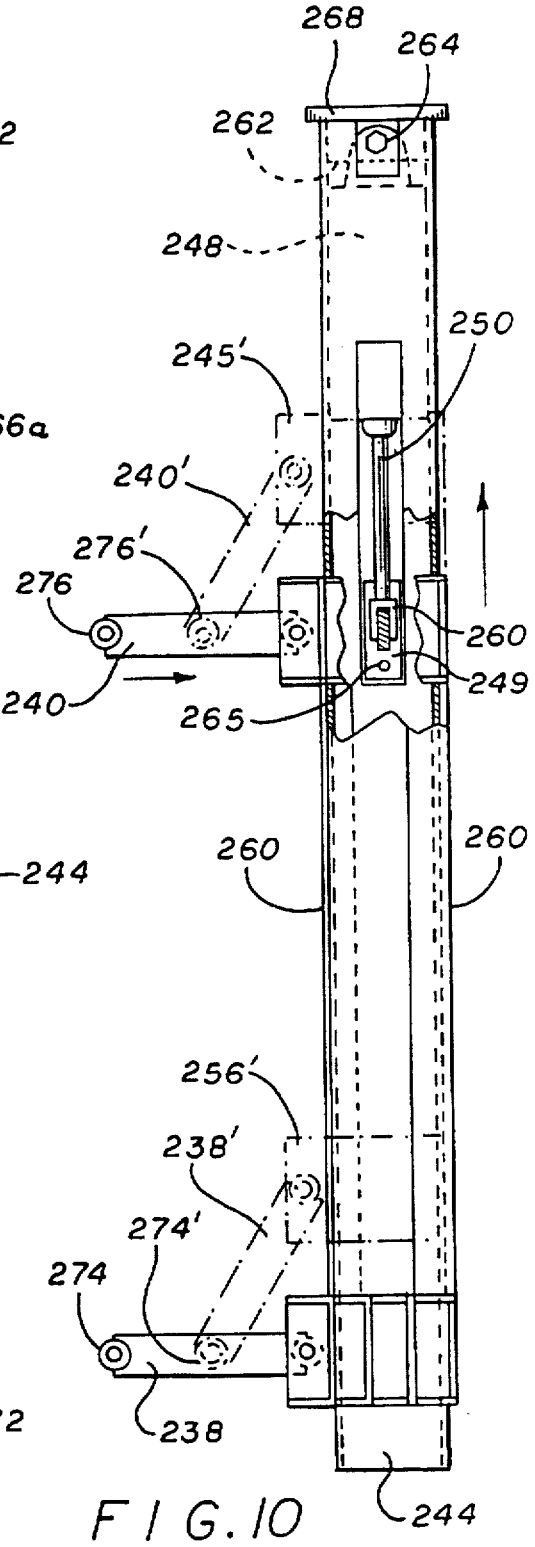
FIG. 10 is a detail and partial sectional view of the internal form corner mechanism of FIG. 9, showing the assembled internal corner mechanism, and its associated links to an internal form, in the open and closed positions.

A hydraulic cylinder 248 having a hydraulic cylinder shaft 250 with a mounting bracket 260 thereon is mounted within the internal tube at internal tube mounting flange 262 by aligning the apertures of mounting bracket 264 with the aperture of mounting flange 262 and securing the two together with a pin. FIG. 10 shows hydraulic cylinder 248 in broken lines mounted within the internal tube.

Mounting bracket 260 at the end of hydraulic cylinder shaft 250 connects by a pin to each H-bracket 249, which in turn is secured within the upper external tube connecting unit 244 by nuts and bolts 265. Internal tube 244 includes two (2) opposing flange cut channels or slots 266*a,b*. The cross bar of each H-bracket 249 crosses both channels 266*a,b* such that the H-bracket may slide up and down within the channels 266, as hydraulic cylinder shaft 250 extends and retracts. An end mounting flange 268 is provided at the top of internal tube 244 and has at least two and preferably four threaded apertures 270 for bolting onto form lifting beam 190. Internal tube 244 also has two lower bolt apertures 272 for mounting bracing members that hold the internal tube 244 in plumb against the lateral load from the pressure of the wet concrete.

FIG. 10 also illustrates the motion of the links 238, 240 as external tube 242 slides upwardly. Shown in solid lines, links 238, 240 are in the closed position with lengths 238, 240 oriented horizontally. Generally speaking, the numbers having a prime thereafter in FIG. 10 represent positions of the respective parts in the open position. When the sliding external tube 242 moves upwardly, connection point 274 and 276 move horizontally outwardly to positions 274' and 276', respectively. Thus, the internal form 214 slides horizontally outwardly with little or no vertical movement.

FIGS. 11 through 13 are detailed sectional views of the upper form tie locking mechanism 290, which acts to prevent the forms from opening from the closed position until the hydraulic system illustrated in FIGS. 6 through 8 is activated to open the forms. Upper form ties 290 include a pivot bracket 292 extending from external form 212, an over center locking link 294 having a key 296, and a U-shaped bracket 298 mounted on internal form 214. Pivot bracket 292 is pivotally mounted onto over center locking link 294 with pivot pin 300. U-shaped bracket 298 is mounted onto over center locking link 294 with sliding pin 302, which slides along slot 304.

In the closed position of FIG. 11, an upwardly extending arm of U-shaped bracket 298 is engaged with key 296, thereby preventing internal form 214 from moving horizontally outwardly. When external form 212 is rotated out to an open position as in FIG. 12, however, key 296 rotates upwardly out of engagement with U-shaped bracket 298. Internal form 214 is then free to slide horizontally into the open position, with sliding pin 302 sliding outwardly within slot 304 as the external tube of the corresponding internal form mechanism moves upwardly. At the fully opened position, pin 302 has slid the full length of slot 304, as shown in FIG. 13.

It is noted that the upper brackets of the forms in FIGS. 6 through 8 are different than the upper brackets of the forms in FIGS. 11 through 13. It is anticipated that both types of brackets will be used at different positions along the forms, with the brackets of FIGS. 6–8 and the brackets of FIGS. 11–13 alternating and being spaced from one another along the length of the wall. The links 238, 240 of FIGS. 6 through 8 are used only where the forms connect to a connector plate 216 (FIG. 6), whereas the brackets of FIG. 11–13 are used in portions of the forms that do not connect with a beam above. Thus, the upward portions of the forms of FIGS. 6–8 serve to connect the forms to the form support structure, while the upper portions of FIGS. 11 through 13 are for the different purpose of tying the forms in the closed position.

Figure 14:
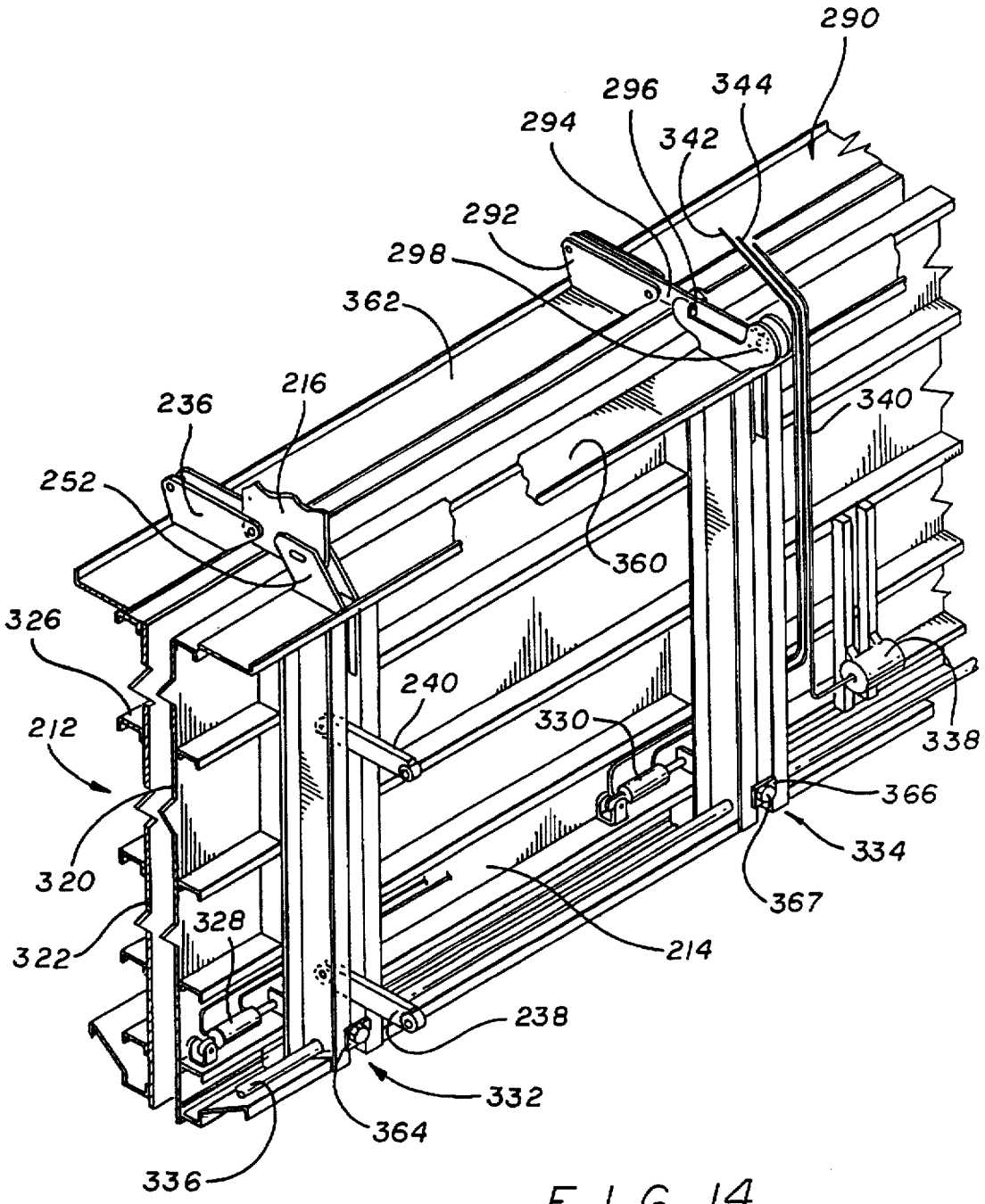
FIG. 14 is a perspective detail view of a form pair, with an internal form having a hydraulic cylinder and a pneumatic vibrator mounted thereon shown in the foreground, and with an associated external form shown in the background.

FIG. 14 shows these two different types of brackets that are shown in a spaced relationship as they would appear on the forms. FIG. 14 also illustrates numerous other details of the forms. Both the internal and external forms are comprised of ¼" inch thick steel form walls 320, 322 having a plurality of horizontal stiffeners 324, 326. These stiffeners are typically C5×6.7 steel members that are approximately 5 inches deep.

Mounted on the lower portion of internal form 214 are hydraulic cylinders 328, 330 that are part of the lower form ties, as explained below. Internal form 214 also includes vertical channels 332, 334, with links 238, 240 protruding from vertical channel 332. The vertical channels are typically C10×15.3 steel members with a depth of approximately 10 inches. Links 238, 240 connect to an internal form mechanism, such as that shown in FIG. 9. Internal form 214 may also include a steam line 336 which passes through apertures in the lower portion of vertical channels 332, 334. Steam line 336 is used for carrying hot steam to aid in rapidly curing the concrete after it has been poured.

Internal form 214 may also include a pneumatic vibrator 338 mounted on a lower portion of the form for vibrating the concrete while curing. This releases air bubbles from within the concrete and helps to form a stronger concrete bond. Air line 340 leads to pneumatic vibrator 338, and hydraulic lines 342, 344 lead to hydraulic cylinders 328, 330.

The upper portion of the forms include the upper form ties 290 having U-bracket 298, pivot bracket 292 and over-center locking link 294, with an upwardly-extending arm of the U-bracket 298 engaged with key 296. Also shown is bracket 236 and angle bracket 252, both of which are connected to a frame support beam connector plate 216. Also on the upper portion of the forms are upper cover plate 360, 362, which act as mounts for a steam curtain (not shown) that may be bolted onto the exterior forms corresponding to the outer walls of the module during the concrete curing process. The steam tent helps to prevent steam from escaping the form area during curing.

Figure 15:
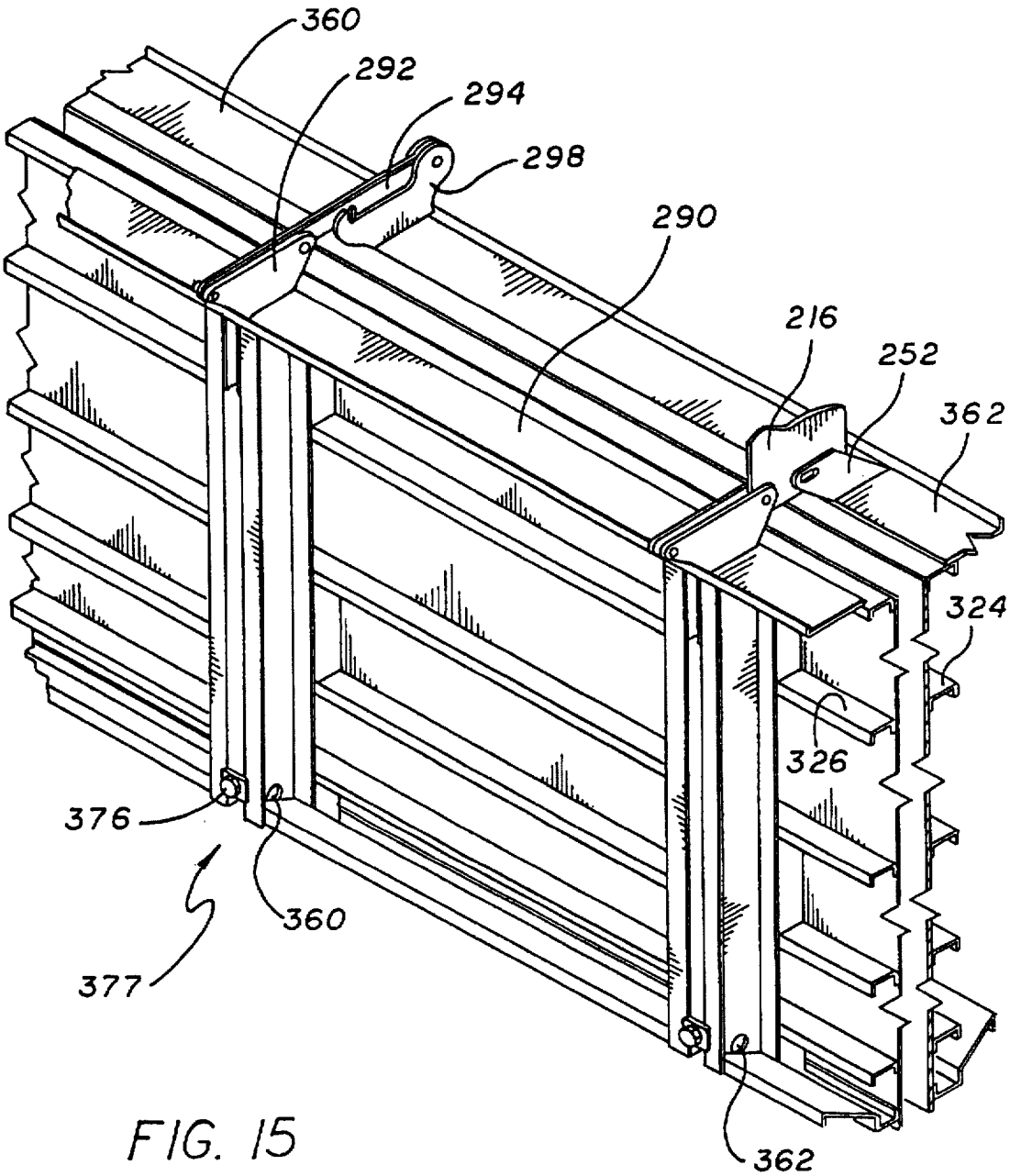
FIG. 15 is the perspective detail view of the form pair of FIG. 14, with the external form in the foreground and the internal form in the background.

FIG. 15 views the forms from the opposite side of the form pair of FIG. 14. The external form 212 normally does not have hydraulic cylinders or pneumatic vibrators mounted thereon. However, steam line apertures 361, 363 are provided so that a steam line may extend along the lower portion of external form 212, with the steam line passing through the vertical channels. Generally speaking, a steam line will run along both the internal forms and the external forms for rapid curing.

Figure 16:
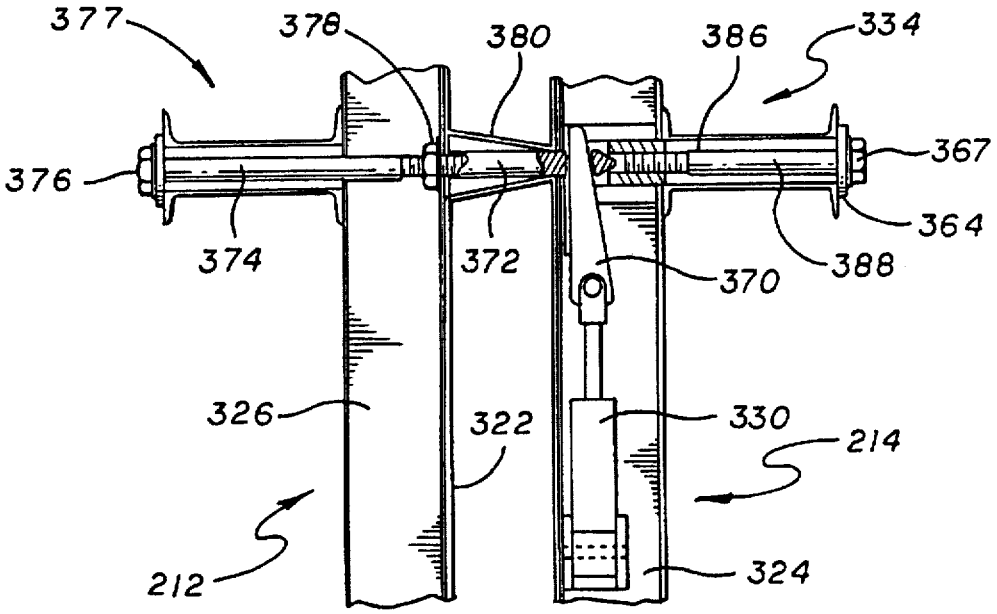
FIG. 16 is a top sectional view taken along Line 16—16 of FIG. 14 showing the tie spear, tie wedge and hydraulic cylinder of the lower form tie mechanism as it appears in the locked position prior to pouring the concrete.

Referring back to FIG. 14, tie plates 364, 366 and hydraulic cylinders 328, 330 relate to a hydraulic tie system for the lower portions of the forms. This lower form tie system is seen in more detail in FIGS. 16 and 17. With reference to FIG. 16, which is a top sectional view taken along line 16—16 of FIG. 14, we see that the lower form tie system includes a hydraulic cylinder 330 and a tie wedge 370 connected to the shaft of hydraulic cylinder 330. Tie wedge 370 is generally a ⅝ inch flat plate having a sharp tip. A tie spear 372 extends from external form 212 across to internal form 214.

The tie spear 372 has a threaded end that screws onto the threads of long bolt 374, which extends through vertical channel 334 and which has a bolt head 376 juxtaposed against tie plate 366. Long bolt 374 has a threaded end portion onto which tie spear 372 screws, and a lock nut 378 is tightened up against external form wall 322.

A generally pyramid-shaped tie spear cover 380 encompasses the tie spear 372 and protects the spear from being fouled with wet concrete. Tie spear cover 380 provides smooth separation of the tie spear from engagement with internal form 214 after the concrete has cured. Without tie spear cover 380, the concrete would bind about the tie spear and could damage the tie spear as it was being retracted from the wall.

Figure 17:
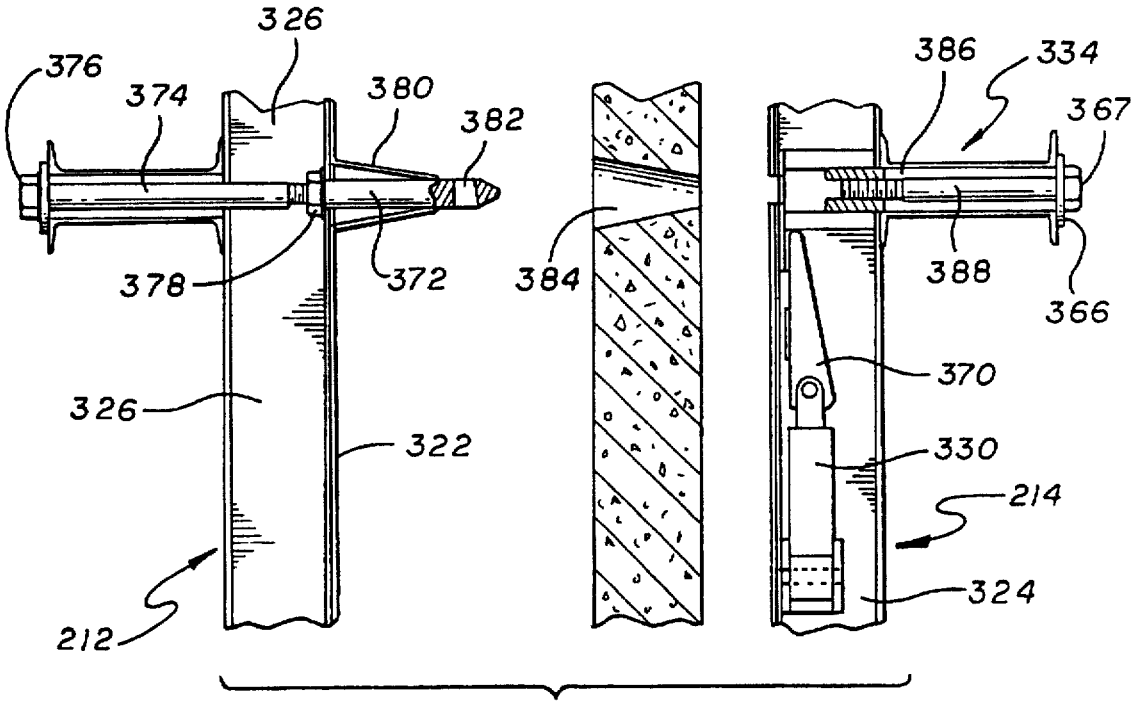
FIG. 17 is the lower form tie mechanism of FIG. 16 with the mechanism unlocked and with the external and internal forms open and spaced away from the cured concrete wall.

Tie spear 372 includes an aperture 382 through which tie wedge 370 extends in the locked position of FIG. 16. To disengage tie wedge 370 from engagement with tie spear 372, the shaft of the hydraulic cylinder is retracted, as seen in FIG. 17. The external form 212 may then be hydraulically rotated open, as explained earlier. Although an opening 384 is left in the vertical concrete wall 108, workers will later fill-in the opening to ensure that the opening causes no significant structural weakening effect.

FIGS. 16 and 17 also illustrate a spear housing 386 and a bolt 388 extending into the housing. The bolt serves to structurally support the spear housing 386, which is subjected to substantial pressure loading from the weight of the wet concrete.

Having discussed the forms with reference primarily to detail views, it may be somewhat helpful to refer to the plan view of FIG. 18, which is actually a bottom sectional view looking upwards into the forms and up to the form support frame. Where elements are repeated in the drawings, successive letters (a, b, c, . . . ) have been used. The full form and support assembly includes guide columns 192 *a–d*, with one at each of the four corners. End form lifting beam 190*a*, *a'*, and 1909*b*, *b'* roll along guide columns 192*a,b* and 192*c,d*, respectively. Hydraulic cylinders 194*a–d* raise and lower the form support frame by attaching to end form lifting beams 190.

The form support structure includes form lifting beams 188*a,b* and 186*a–c*. The upper beam support structure includes upper frame beams 197*a–d*. External forms are represented by reference numerals. 212*a–e*, while internal forms are presented by reference numerals 214*a–e*. Hydraulic cylinders 220*a–l* open and close external forms 212*a–e*. Internal form mechanisms 222*a–h* open and close internal forms 214*a–e*. FIG. 18 also illustrates various vertical columns on the interior and exterior forms, as well as various cross braces, one of which has been assigned the reference numeral 399.

Figure 19:
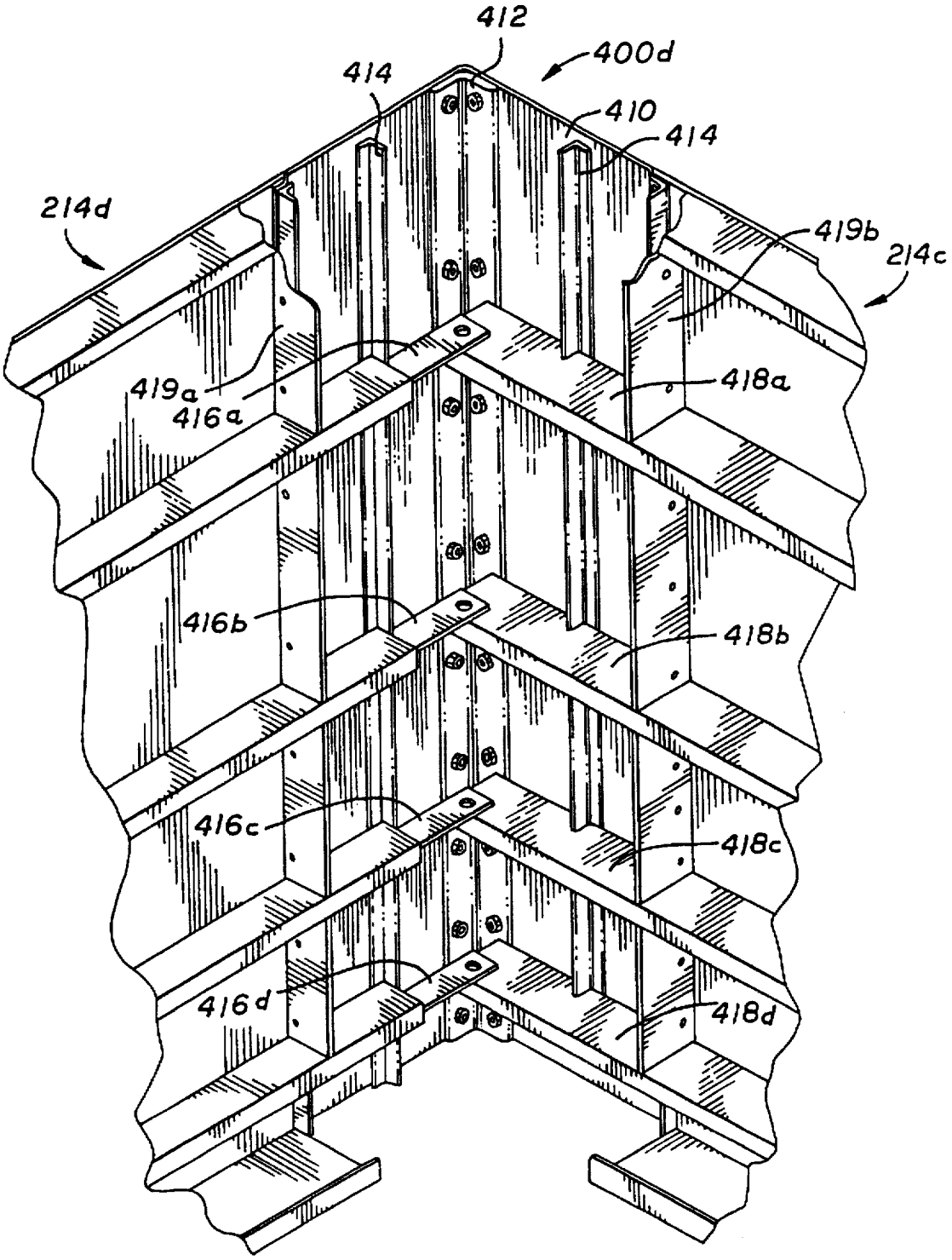
FIG. 19 is a perspective view of an internal corner in the closed position.
Figure 20:
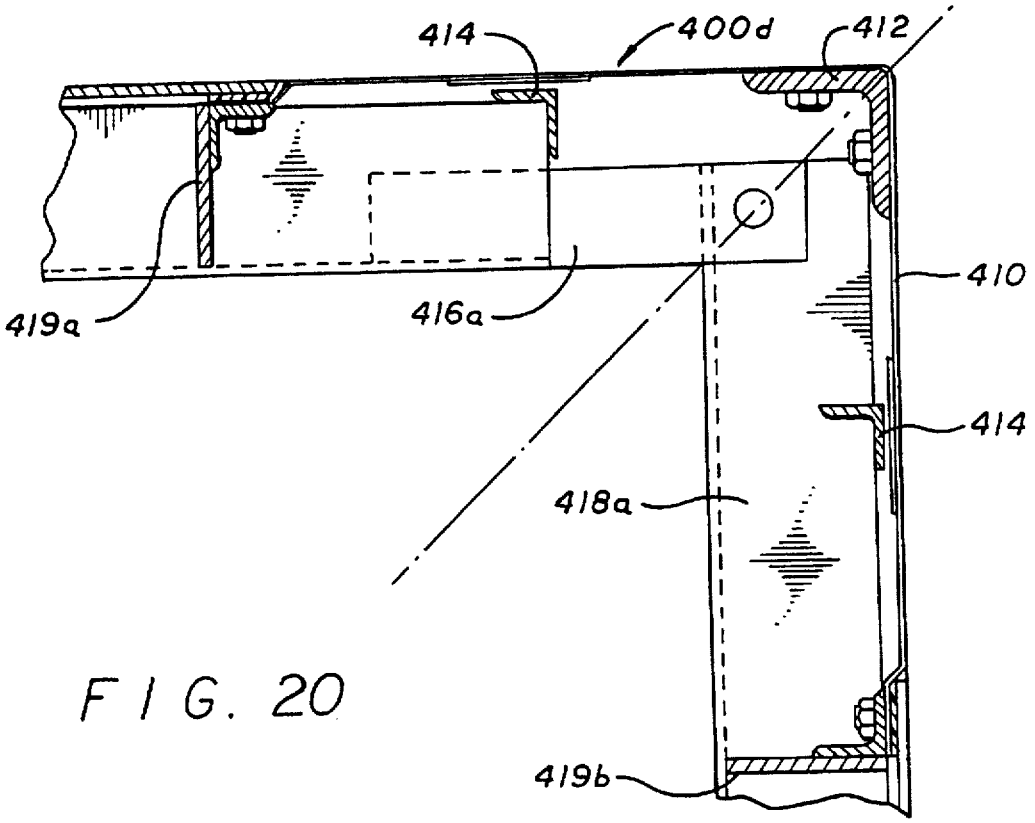
FIG. 20 is a top view of the internal corner of FIG. 19.
Figure 21:
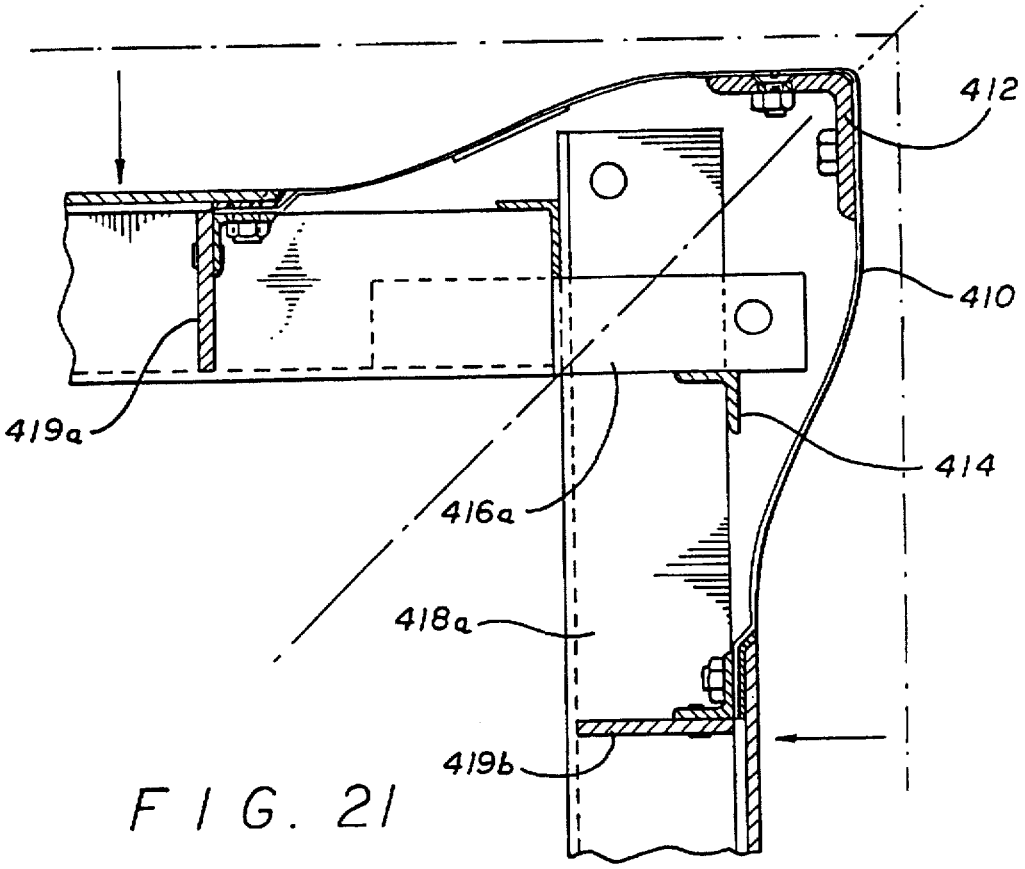
FIG. 21 is a top view of the internal corner of FIG. 19 in an open position.

Special problems arise with internal corners 400*a–d* when the internal forms are opened. Without some special arrangement, the internal corners would interfere with one another when adjacent perpendicular interior walls both attempted to open simultaneously. FIGS. 19–21 illustrate a special structural arrangement for the inner form corners. FIG. 19 is a detailed perspective view of a flexible internal corner 400*d*. The corner includes flexible sheet material 410, a corner bracket 412 and angle irons 414. Flexible sheet material 410 may be a high strength, 14 gauge sheet metal, such as the COR-10 material manufactured by the U.S. Steel Corporation. However, the flexible internal corners may alternatively be constructed with other suitable high strength, flexible materials.

Inner forms 214*c*, *d* are bolted to ends of flexible sheet material 410. Corner bracket 412 serves to maintain flexible sheet material 410 in an angular configuration in the closed position of FIG. 19. Inner form 214*d* includes overlying extending members 416*a–d*. Inner form 214*c* includes underlying extending members 418*a–d*. Vertical stiffeners 419*a,b* provide vertical form structural strength.

As FIG. 19 shows, in the closed position, the apertures of the respective overlying and underlying extending members line up together, such that flexible sheet material 410 is maintained at an approximate 90 degree angle. A pin is extended through the aligned apertures when the form is being constructed, to ensure alignment of the forms. However, once the forms have been built, no pin is typically extended through the apertures. FIG. 20 is a top view of the inner form corner as it appears in the closed position of FIG. 19.

As the inner forms both open, overlying extending members 416*a–d* and underlying extending members 418*a–d* slide inwardly, and flexible internal corner 400*d* flexes accordingly. The walls of flexible sheet material 410 are no longer linear as in the closed position of FIG. 19, but rather take on a curve shape in order to accommodate the movement of the extending members. Thus, there is no interference between inner form 214*c* and *d* as the inner forms open and close.

Figure 22:
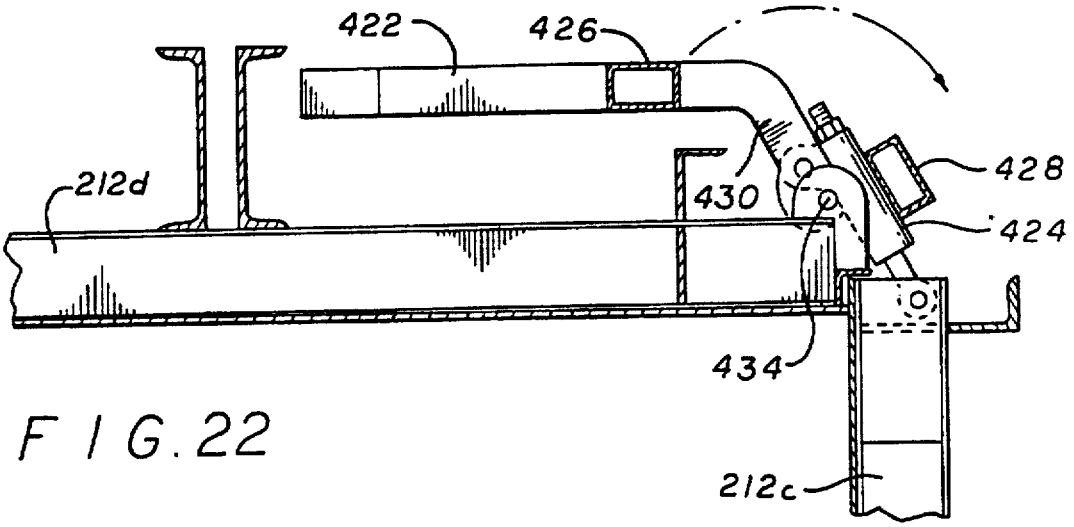
FIG. 22 is a top view of a corner between two external forms illustrating the external corner mechanism in a locked position.
Figure 23:
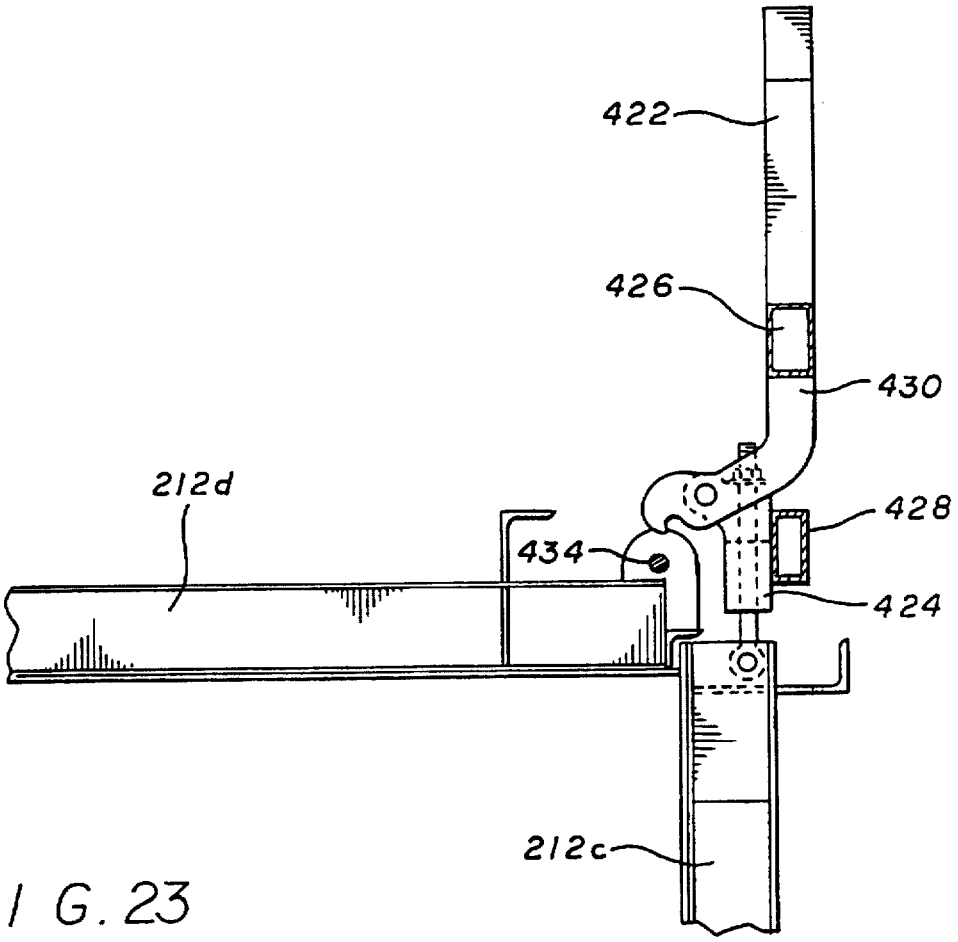
FIG. 23 is a top view of the external corner mechanism of FIG. 22 in an unlocked position.

The present form assembly also includes manual external form locking mechanisms, illustrated in FIGS. 22 and 23. These mechanisms are represented as reference numerals 420*a–d* in FIG. 18. The mechanisms each include a single handle 422 and a plurality of pivot mechanisms 424, also called eye-bolts, extending in a spaced relationship vertically along the exterior corner. A plurality of locking hook members 430 also extend vertically in a spaced relationship along the exterior corner. A vertical tube 426 interconnects the locking hook members 430, while a vertical tube 428 interconnects the pivot mechanisms 424.

As a worker manually pushes the handle 422 inwardly toward the first external form 212*d*, vertically spaced locking hook members 430 engage about respective locking pins 434. The external form corner is then locked into position, and will retain the corner angle once concrete has been poured into the forms. To unlock the corner mechanism, the worker manually pulls the handle 422 away from the first external form 212*d* to disengage locking hook members 430 form the respective locking pins 434.

Figure 24:
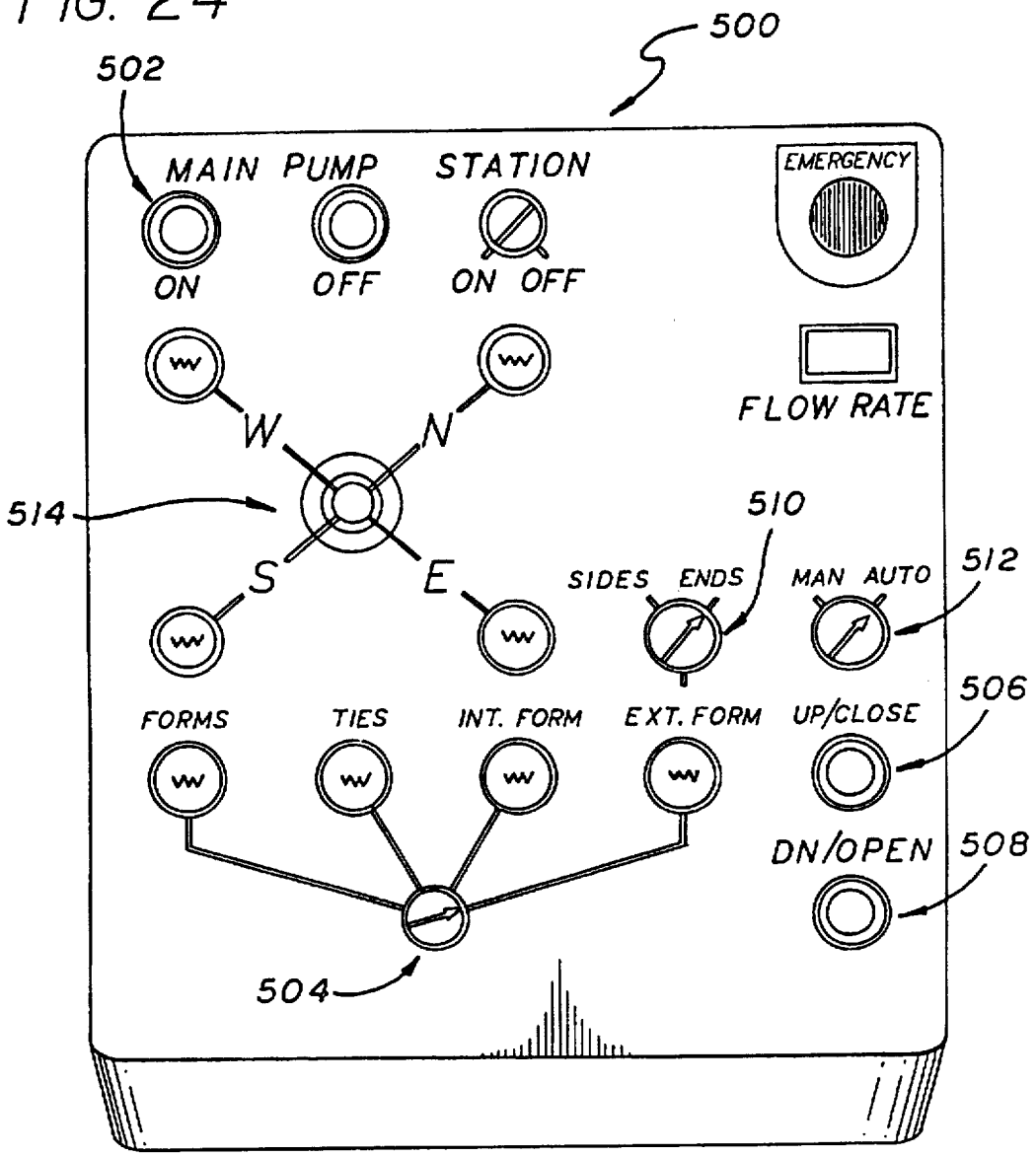
FIG. 24 is a perspective view of the hydraulic system control panel, from which an operator can raise and lower the forms, open and close the forms, lock and unlock the lower form ties, and optionally manually control the relative extensions of the hydraulic cylinders that raise and lower the forms.
Figure 24:
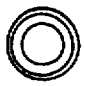
Figure 24:
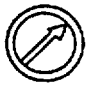
Figure 24:
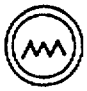

The numerous hydraulic systems of the above-identified embodiment of the present invention are all controlled from a single control panel. FIG. 24 shows one such exemplary hydraulic control panel 500. From this panel 500, an operator may control the raising and lowering of the forms, the opening and closing of the form ties, and the opening and closing of the internal and external forms. The operator may initiate operation of the hydraulic system by pressing the "on" button 502, which turns on the main hydraulic pumps. The operator then turns selector switch 504 to either the "forms" position for raising and lowering the forms, the "ties" position for opening and closing the form ties, the "INT. form" position for opening and closing the internal forms or the "EXT form" position for opening and closing the external forms. The operator may initiate raising and closing operations by pushing button 506. The operator may initiate lowering and opening operations by pressing button 508. When opening and closing the external forms, the operator must open the side external forms and the end external forms separately. The operator selects which of the two he or she wishes to operate with selector switch 510. All of the internal forms may be opened or closed simultaneously, and selector switch 510 does not affect opening and closing of the internal forms.

Referring now to manual/auto selector switch 512, the control console is equipped with a Programmable Logic Control (PLC) unit which is programmed to control the solenoid valves of the hydraulic system to level the forms during lifting and lowering. The PLC unit receives signals from four magnetic sensors indicating the form position. During lifting, if the magnetic sensors inform the PLC that one of the corners of the forms is more than 2 inches higher than the others, the PLC unit will hold the particular hydraulic corner cylinder 195*a, b, c* or *d* by bleeding off hydraulic fluid from that particular cylinder. The PLC will continue to hold the particular cylinder until all four corners of the form assembly are substantially at the same vertical level.

If for some reason the system fails, and any of the four corners is at a level of more than four inches above or below the level of the other corners, the PLC unit will shut down operation of the entire system for raising and lowering the forms. The forms may then be lowered or raised manually by setting the selector switch 512 to "manual", or by some alternative arrangement.

The operator may disable the PLC level control system by setting the selector switch 512 to manual. The operator may then use joystick 514 to control the level on each of the four corners of the form assembly. Each of the designations "W", "N", "S" and "E" represents one of the four corners of the form assembly at the location of a respective raised/lower hydraulic cylinder. Consequently, the operator may lower the "W" corner while maintaining the level of the other three corners by moving the joystick towards the imprinted "W" location on the control panel.

Figure 25:
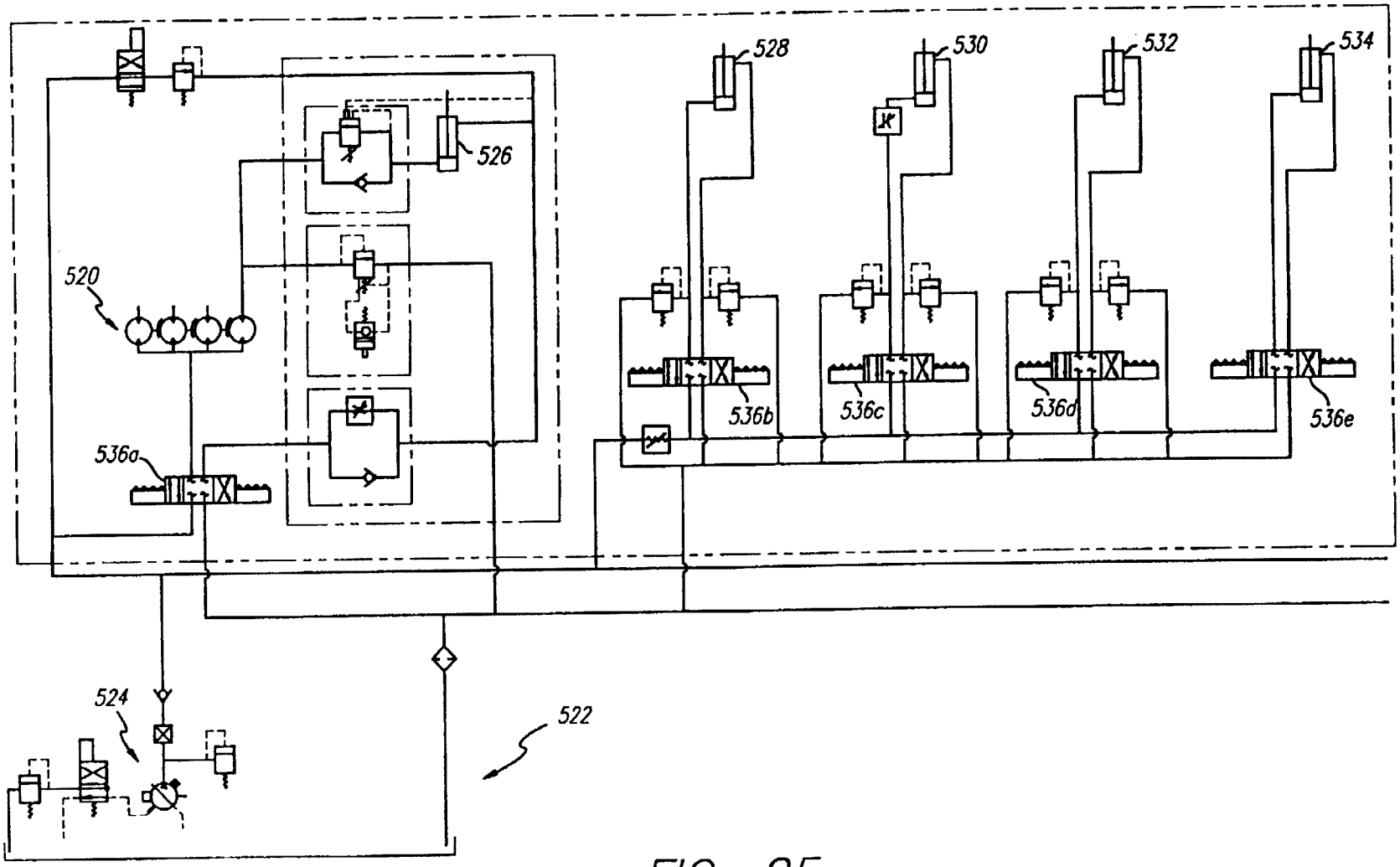
FIG. 25 is a diagram of the hydraulic system that the control panel of FIG. 21 controls.

FIG. 25 is a simplified diagram of the overall hydraulic system. Hydraulic pump 524 pumps hydraulic fluid from hydraulic fluid reservoir 522. Hydraulic cylinders 526 represent the raise/lower cylinders 194*a–d*, while reference numeral 520 refers to flow dividers. Hydraulic cylinder 528 represents the hydraulic cylinders mounted within the internal form mechanisms 222*a–h* for opening and closing the internal forms. Hydraulic cylinders 530 represent hydraulic cylinders 220*a–l* for opening and closing the external forms. Hydraulic cylinders 532 represent the hydraulic cylinders 330 for engaging and disengaging the lower form ties. Finally, hydraulic cylinders 534 represent the hydraulic cylinders 220 on the two remaining opposing sides of the form assembly.

Hydraulic control panel 500 controls the solenoid valves 536*a–e* by sending electronic commands to open and close the valves. Consequently, the operator is able to control different hydraulic functions one at a time by pressing the appropriate control buttons.

Figure 26:
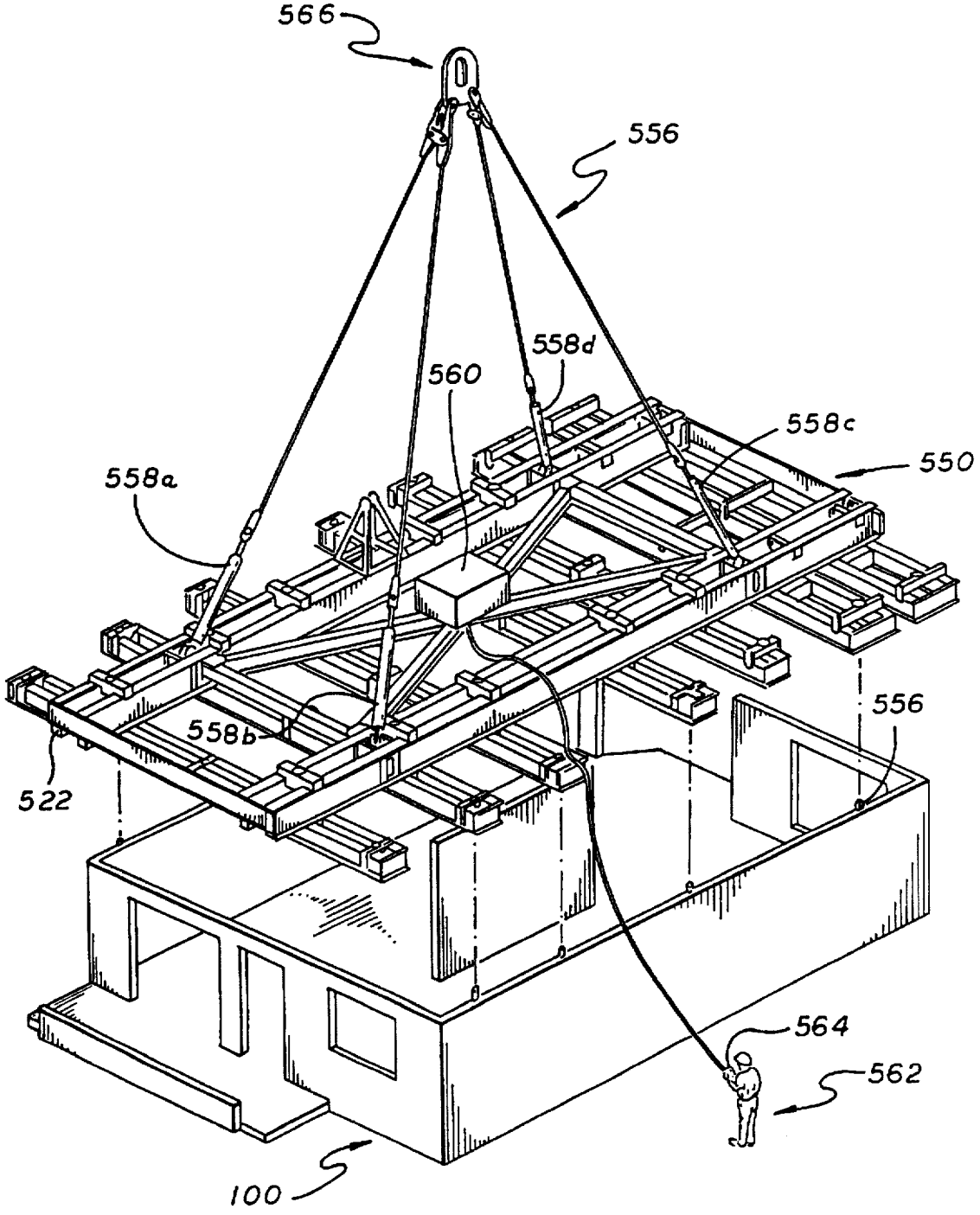
FIG. 26 is a perspective view of an operator lowering the form lifting frame over a completed module to connect with the module to lift it onto a transporter.

Once module 100 has been fully cast, with the concrete cured and strength tested, a 230 ton crawler crane equipped with a lifting frame 550 lifts the module 100 and moves it onto a transporter (not shown). FIG. 26 is a perspective view of the lifting frame 550 being lowered onto a finished module 100. The lifting frame 550 provides a safe and quick method to lift the module 100 while keeping it level. Lifting frame has a main longitudinal frame 552, a transverse subframe 554, a manual hydraulic leveling system and lifting wire sling 556.

Figure 27:
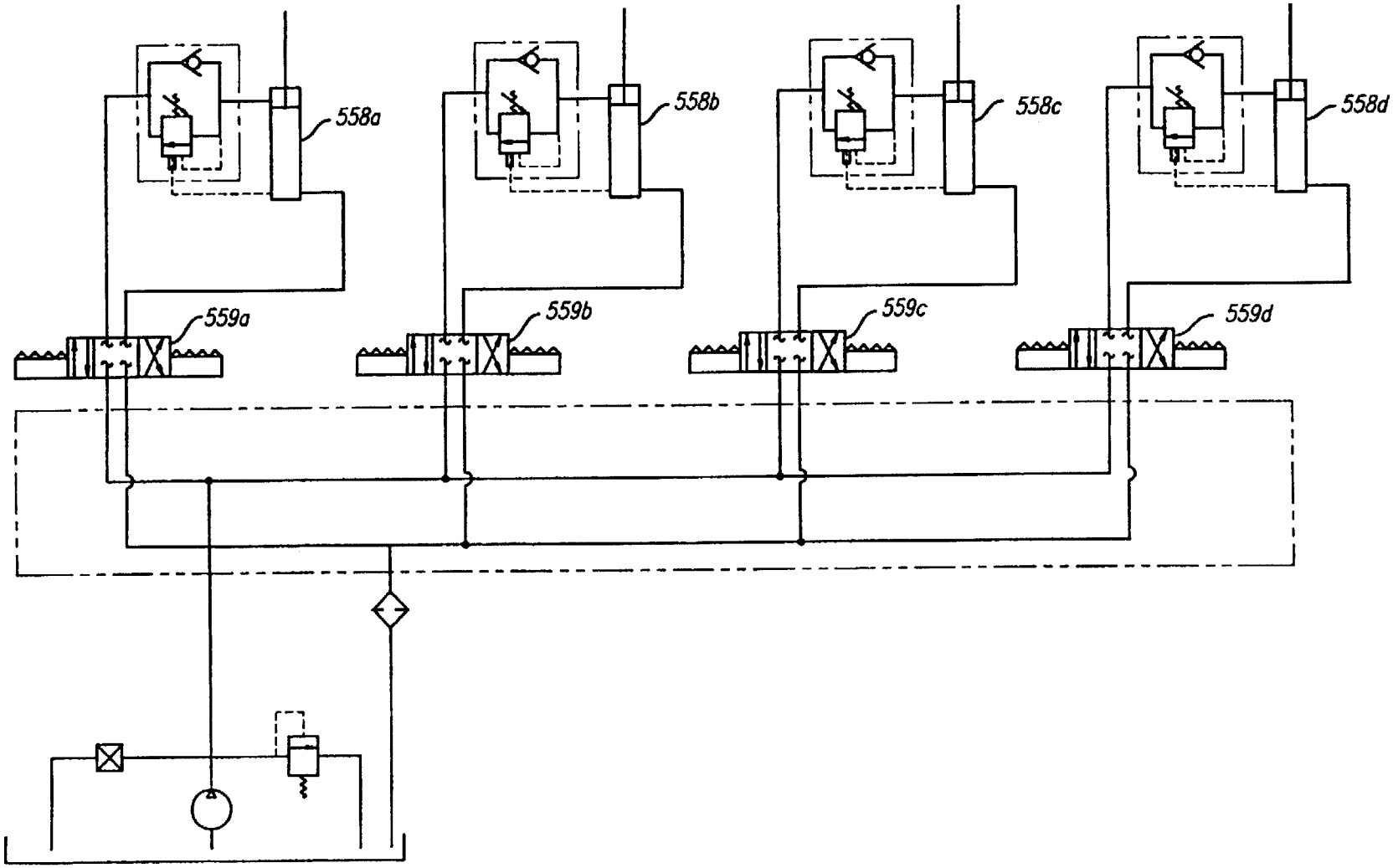
FIG. 27 is a diagram of the hydraulic subsystem for the form lifting frame of FIG. 26.

Hydraulic cylinders 558*a–d* are connected directly to the main longitudinal frame 552. A hydraulic pump 560 is in communication with each of the four hydraulic cylinders 558*a–d*. The operator 562 controls the flow of hydraulic fluid to the four cylinders 558*a–d* with control unit 564, and is thereby able to adjust the level of the four corners of the lifting frame 550. FIG. 27 illustrates the lifting frame hydraulic system schematically, showing hydraulic cylinders 558*a–d* and associated solenoid valves 559*a–d*, which the operator controls with hand-held pendent control unit 564.

Referring back to FIG. 26, when lifting frame 550 is lowered to a position just above hook plates 566, locking units on frame 550 engage with hook plates 566 to lock the lifting frame 550 with the module 100. The module 100 can then be lifted by the crawler crane (not shown) which attaches to the lifting frame at hook plate 567. The unit is lifted onto a transporter and carried to the building site. The module 100 is then lifted off the transporter and raised into position onto the building for interconnection with other modules.

Returning now to the various hydraulic cylinders, the following specifications are given as examples only, and are not intended to be limiting. The hydraulic cylinders for raising and lowering the forms may have a 6 inch bore, a 108 inch stroke and a 4 inch rod with double pistons. The hydraulic cylinders for opening and closing the external forms may have a 4 inch bore, a 30 inch stroke and a maximum width of 2¼ inches. The hydraulic cylinders for opening and closing the internal forms may have a 4 inch bore, a 12 inch stroke and clevis ends with 1 inch pins. The hydraulic cylinders for the lower form ties may have a 3 inch bore, and 8 inch stroke and clevis ends with 1 inch pins. The hydraulic cylinders for the lifting frame may be 7 inch by 36 inch.

In conclusion, it is to be understood that the foregoing detailed description and the accompanying drawings illustrate the preferred environments of the invention. However, various changes and modifications may be made without departing from the spirit and scope of the invention. Accordingly, the present invention is not limited to the embodiment shown in the drawings or described in detail hereinabove.

What is claimed is:

1. An efficient method of manufacturing precast concrete modules comprising entire offices or apartments, said method using a hydraulic system that is controlled from one or more control panels, and said method comprising the steps of:

laying a pattern of slab reinforcement bars and conduits;

pouring concrete over said pattern of slab reinforcement bars and conduits to form a reinforced concrete slab;

erecting a pattern of wall reinforcement bars and conduits on said reinforced concrete slab;

hydraulically lowering wall form pairs, each pair comprising an internal wall form and a corresponding external wall form, to encompass said pattern of wall reinforcement bars and conduits;

hydraulically closing each of said wall form pairs about said pattern of wall reinforcement bars and conduits to provide a mold cavity between said internal wall form and said corresponding external wall form of each wall form pair;

pouring concrete into said mold cavities of said closed wall form pairs;

steam curing said concrete that has been poured into said mold cavities of said closed form pairs to form vertical reinforced concrete walls joined to said reinforced concrete slab;

hydraulically opening said wall form pairs; and hydraulically lifting said wall form pairs to a position above said vertical reinforced concrete walls of said precast concrete module.

2. A method of manufacturing precast concrete modules as claimed in claim 1, further comprising a step of hydraulically tying each internal wall form to said corresponding external wall form to prevent said external wall form from moving relative to its corresponding internal form.

3. A method of manufacturing precast concrete modules as claimed in claim 1, wherein said steps of hydraulically lowering said wall form pairs, hydraulically closing said wall form pairs and hydraulically opening said wall form pairs are all initiated from said one or more control panels.

4. A method of manufacturing precast concrete modules as claimed in claim 1, wherein said step of hydraulically lowering wall form pairs includes automatically keeping said wall form pairs level as said wall forms pairs descend.

5. A method of manufacturing precast concrete modules as claimed in claim 1, wherein at least two external forms are adjacent to one another to form a corner, and wherein said method further includes a step of locking said corner in place.

6. A method of manufacturing precast concrete modules as claimed in claim 1, wherein said method further includes blocking out openings in said module, and wherein block-outs extend from walls of said wall form pairs.

7. A method of manufacturing precast concrete modules as claimed in claim 1 wherein said step of hydraulically opening said wall form pairs includes rotating said external wall forms open and moving said internal wall forms horizontally.

8. A method of manufacturing precast concrete modules as claimed in claim 1, wherein said method further comprises a step of performing finishing tasks on said vertical reinforced concrete walls.

9. An efficient method of manufacturing vertical walls on a precast concrete module, said method using a hydraulic system that is controlled from one or more control panels, the method comprising the steps of:

erecting a pattern of wall reinforcement bars and conduits;

hydraulically lowering wall form pairs, each pair comprising an internal wall form and a corresponding external wall form, to encompass said pattern of wall reinforcement bars and conduits;

hydraulically closing each of said wall form pairs about said pattern of wall reinforcement bars and conduits to provide a mold cavity between said internal wall form and said corresponding external wall form of each wall form pair;

pouring concrete into said mold cavities of said closed wall form pairs;

curing said concrete that has been poured into said mold cavities of said closed form pairs to form vertical reinforced concrete walls;

hydraulically opening said wall form pairs; and hydraulically lifting said wall form pairs to a position above said vertical reinforced concrete walls of said precast concrete module.

* * * * *